US006360806B1

(12) United States Patent
Bowman et al.

(10) Patent No.: US 6,360,806 B1
(45) Date of Patent: Mar. 26, 2002

(54) OPERATION, CONTROL AND SUSPENSION SYSTEM FOR A VERTICAL VANE COVERING FOR ARCHITECTURAL OPENINGS

(75) Inventors: Ronald L. Bowman, Golden; Paul G. Swiszcz, Boulder, both of CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 09/543,305

(22) Filed: Apr. 5, 2000

(51) Int. Cl.[7] ..... E06B 9/36

(52) U.S. Cl. ..... 160/168.1 V; 160/176.1 V; 160/178.1 V

(58) Field of Search ..... 160/168.1 V, 176.1 V, 160/173 V, 177 V, 178.1 V, 330, 348; 16/87.4 R

(56) References Cited

U.S. PATENT DOCUMENTS

| | | | | |
|---|---|---|---|---|
| 2,135,647 A | | 11/1938 | Streby | 156/17 |
| 2,604,161 A | | 7/1952 | Bopp et al. | 160/176 |
| 2,755,854 A | | 7/1956 | McIntire | 160/176 |
| 2,822,043 A | | 2/1958 | Horak | 160/172 |
| 2,869,636 A | | 1/1959 | Klenz | |
| 3,031,013 A | | 4/1962 | Russell | 160/236 |
| 3,070,855 A | | 1/1963 | Hallock | 20/62 |
| 3,151,665 A | | 10/1964 | Stack | 160/206 |
| 3,534,801 A | | 10/1970 | Bolden | 160/172 |
| 3,633,646 A | * | 1/1972 | Zilver | |
| 4,102,381 A | | 7/1978 | Bratschi | 160/168 R |
| 4,350,197 A | | 9/1982 | Haller | 160/166 A |
| 4,356,855 A | | 11/1982 | Holzer | 160/178 R |
| 4,361,179 A | | 11/1982 | Benthin | |
| 4,386,644 A | * | 6/1983 | Debs | |
| 4,425,955 A | | 1/1984 | Kaucic | |
| 4,425,956 A | * | 1/1984 | Terlecke | |
| 4,473,102 A | * | 9/1984 | Ohman et al. | |
| 4,628,981 A | | 12/1986 | Ciriaci et al. | 160/176 R |

(List continued on next page.)

FOREIGN PATENT DOCUMENTS

| | | |
|---|---|---|
| CH | 393707 | 6/1965 |
| DE | 914307 | 7/1954 |
| DE | 1654095 | 2/1971 |
| DE | 25 11 001 | 9/1975 |
| EP | 0063265 | 10/1982 |
| FR | 1.567.102 | 4/1969 |
| FR | 2.031.503 | 11/1970 |
| JP | 02-13678 | 4/1990 |

*Primary Examiner*—Blair M. Johnson
(74) *Attorney, Agent, or Firm*—Dorsey & Whitney LLP

(57) ABSTRACT

A covering for an architectural opening includes a new system for mounting the controls for the covering within the head rail such that suspended vertical vanes are closely positioned relative to the bottom of a head rail and disposed so as to form a continuous and integrated look with the head rail. An improved pantograph is used in the control system with one set of links of the pantograph having tapered side edges to improve stacking of the vanes adjacent to the end of a head rail without sacrificing strength and therefore quality of the control system. An improved operating system in the form of the combination of a tilt wand, coupler and pull cord provides a simplified system for not only moving the vanes along the length of the head rail between extended and retracted positions but for also pivoting the vanes about longitudinal vertical axis between open and closed positions. An improved system for connecting suspended vanes to the control system is also provided with the system being uniquely designed for use with tubular vanes and retains the vanes in a tubular orientation. The tilt wand is connected to the tilt rod within the head rail by an inclined drive connector that enables the tilt wand to be aligned with the pull cord at the location where the pull cord drops from the head rail for manipulation by an operator. In this manner, the combined tilt wand and pull cord establish a substantially child-proof operating system for the covering.

38 Claims, 14 Drawing Sheets

U.S. PATENT DOCUMENTS 4,936,369 A * 6/1990 Darner
4,967,823 A * 11/1990 Gagnon
5,465,775 A * 11/1995 Biba et al.
5,465,779 A * 11/1995 Rozon
5,553,649 A * 9/1996 Chisaka et al.
5,626,177 A * 5/1997 Colson et al.
5,682,938 A * 11/1997 Hsu
5,797,442 A 8/1998 Colson et al.
5,819,833 A 10/1998 Swiszcz et al.
5,853,039 A 12/1998 Fraser et al. ..... 160/178.1 V
5,992,495 A * 11/1999 Cadorette
6,076,588 A * 6/2000 Swiszcz et al.

* cited by examiner

OPERATION, CONTROL AND SUSPENSION SYSTEM FOR A VERTICAL VANE COVERING FOR ARCHITECTURAL OPENINGS

BACKGROUND OF THE INVENTION

1. Field of the Invention

The present invention relates generally to coverings for architectural openings such as doors, windows and the like, and more particularly to an operation, control and suspension system for a covering having a plurality of vertically suspended vanes that are movable between extended and retracted positions relative to the architectural opening as well as pivoted between open and closed positions to control visibility and the passage of light through the architectural opening.

2. Description of Relevant Art

Coverings for architectural openings such as doors, windows and the like have been known in various forms for many years. One form of such covering is commonly referred to as a vertical vane covering wherein a control system suspends and is operable to selectively manipulate a plurality of vertically suspended vanes such that the vanes can be moved laterally across the architectural opening to extend or retract the covering and pivoted along longitudinal and vertical axes to open and close the vanes.

Control systems for operating vertical vane coverings typically include a head rail in which a plurality of carriers associated with each vane are movably mounted for lateral movement and include internal mechanisms for pivoting each of the vanes about a vertical axis. The head rails vary in construction and configuration to house the various types of carriers, but typically the head rails are relatively large in cross section to enclose the working components of the system and have a slot along a bottom or side wall through which a portion of each carrier protrudes for connection to an associated vane. As such, the head rails are typically aesthetically unattractive.

An example of a control system wherein a head rail includes a slot along a side thereof through which a portion of the carriers protrudes is shown in U.S. Pat. No. 4,425,955, issued to Kaucic on Jan. 17, 1984. One problem with head rails having a slot in the side thereof resides in the fact that the slot is sometimes visible in the room in which the system is mounted and therefore is aesthetically unattractive.

U.S. Pat. No. 4,361,179, issued to Benthin on Nov. 30, 1982 discloses a head rail having an opening through the top thereof so as to improve the aesthetics of the head rail. The carriers in the control system are primarily confined within the interior of the head rail and generally C-shaped hangers associated with each carrier circumscribe the head rail so as to be in a position to support an associated vane from beneath the head rail. The Benthin patent accordingly addresses the desire of having the opening in the head rail concealed from normal view. The drawback with a system of the type disclosed in the Benthin patent resides in the fact that the carriers are primarily confined within the head rail thereby necessitating a head rail with a fairly large cross section which is in and of itself aesthetically unattractive.

A patent of interest from the standpoint of minimizing the size of the head rail is U.S. Pat. No. 2,869,636 which shows a relatively thin head rail having a slot in a rear wall thereof through which each carrier projects and wherein most of the carrier components are disposed outside the head rail. The head rail, while being relatively small, is oval in configuration with the broad side of the oval facing the interior of the room in which the system is mounted so as to undesirably present a relatively large profile.

Numerous systems have been provided for operating vertical vane coverings with such systems varying from pull cords or beaded chains to control wands or various combinations thereof. More recently, attempts have been made to consolidate the operation of vertical vane coverings into a simplified system wherein pull cords are utilized to laterally move the vanes along the head rail while an operably interconnected tilt wand is provided for pivoting each vane about a vertical longitudinal axis. An example of such a system is disclosed in U.S. Pat. No. 5,819,833, issued to Swiszcz et al. on Oct. 13, 1998 with this patent being of common ownership with the present application. Due to the problems in combining two diverse functions into one operating system it is difficult to devise a simplified yet dependable system.

As mentioned previously, head rails have traditionally been somewhat aesthetically unattractive and particularly when combined with vertical vanes which have also suffered from the same aesthetic drawback in that they are typically flat relatively rigid bodies with very little or no aesthetic appeal. Improvements in the appearance of the vanes themselves have been made by forming the vanes into a tubular form as disclosed in U.S. Pat. No. 5,797,442, issued to Colson, et al. on Aug. 25, 1998 which is also of common ownership with the present application. While the tubular form of the vanes is an improvement aesthetically, the contrast of tubular vanes with typical square cross-sectioned head rails has also proven to be aesthetically unattractive.

As will further be appreciated, it is important in vertical vane coverings that when the vanes are drawn to one or both sides of the architectural opening, so that they are horizontally stacked along the side of the opening, it is desirable that the vanes be drawn very closely together to occupy a minimal amount of space. A well-known system for moving the vanes laterally of the architectural opening along the length of the head rail has been a pantograph that includes a plurality of pivotally interconnected links. The links need to be of a predetermined strength to deal with the weight of the covering and this strength has typically been derived at least partly through the width of the links and when the pantograph is contracted so that the links are in abutting side-by-side relationship, the width becomes critical to how closely the vanes can be stacked in their fully retracted position. Accordingly, improvements in pantograph construction could improve the stacking characteristics of a vertical vane covering.

Further, while numerous systems have been employed for suspending the vanes from the carriers of the control system for the covering, simplified systems for doing so are always desirable and particularly in a covering of the type that utilizes tubular vanes so that the tubular orientation of the vane can be maintained.

As will be appreciated, while the prior art includes many different forms of operating and control systems for vertical vane coverings as well as different configurations for head rails in which various types of carriers are movably mounted, most suffer from aesthetic drawbacks related either to the size of the head rail or the manner in which it is presented to the interior of the room in which the system is mounted and improvements in such head rails as well as the control and operating systems associated therewith have been needed.

It is to overcome the shortcomings in the prior art systems and to provide a new and improved operating, control and suspension system for a vertical vane covering that the present invention has been made.

SUMMARY OF THE INVENTION

The operation, control and suspension system of the present invention is adapted for use in a covering for an architectural opening and particularly a covering that includes a plurality of vertically suspended vanes. The vanes are suspended from carriers that are mounted in a head rail for lateral movement relative to the architectural opening and linear movement along the length of the; head rail. The carriers are somewhat confined within the head rail and project rearwardly through an opening in the back of the head rail so as to suspend the vanes from the rear of the head rail and in a unique location to improve the aesthetics of the covering. The carriers are operatively connected to a pull cord utilized to reciprocally move the carriers along the length of the head rail and also to a tilt rod, the rotation of which causes each of the vanes to pivot about a longitudinal vertical axis.

The head rail is designed so as to have a front face that inclines downwardly and rearwardly and terminates in alignment with the leading or front edge of the vanes when the vanes are in an open position perpendicular to the architectural opening. This relationship between the front wall of the head rail and the leading edge of the vanes leaves a visual impression of a continuous line along the front edge of the covering which is pleasing to the eye.

The operating system for the covering includes a tilt wand, a pull cord and a coupler that are integrated into one simplified operating system. The wand is vertically suspended from one end of the head rail and is operably interconnected with the tilt rod in the headrail such that rotation of the wand effects rotation of the tilt rod and thus pivotal movement of each vane about a vertical, longitudinal axis. The pull cord is operatively connected to the carriers for moving the carriers along the length of the head rail and extends in two vertical runs into and out of the coupler in a continuous manner so that depending on which vertical run of the cord is pulled, the vanes are moved in a desired direction along the length of the head rail. The coupler is rotatably disposed on the wand so that in operation, the coupler can be held in one hand and the wand rotated with the other when effecting pivotal movement of each vane about a longitudinal vertical axis.

The pull cord and the tilt rod extend in side-by-side horizontally spaced relationship with each other along the length of the head rail and a drive connector connects the upper end of the tilt wand to the tilt rod in a manner such that the tilt wand is aligned with the pull cord as it depends from the end of the head rail. The drive connector is mounted at an acute angle relative to vertical to properly position the tilt wand in vertical alignment with the pull cord.

The control system for the covering includes a horizontally disposed pantograph that operably interconnects the carriers in the head rail so that upon movement of the pull cord, the vanes that are suspended from the carriers move in a desired and predictable manner between retracted and extended positions across the architectural opening. In order to assure a close side-by-side horizontal stacking of the vanes adjacent one or both sides of the architectural opening when the covering is in the retracted position, the links in at least one set of links in the pantograph have been tapered along their sides so that without sacrificing strength in the pantograph, the links can be more closely positioned relative to each other when the pantograph is contracted in moving the vanes to the retracted position of the covering.

The covering also includes a unique connector for connecting the suspended vanes from the carriers with the connector being designed to not only releasably receive an upstanding tab on the upper end of an associated vane but to also cooperate with the vanes that are of tubular configuration in retaining the tubular configuration.

Other aspects, features and details of the present invention can be more completely understood by reference to the following detailed description of a preferred embodiment, taken in conjunction with the drawings and from the appended claims.

DESCRIPTION OF THE PREFERRED EMBODIMENTS

Figure 1:
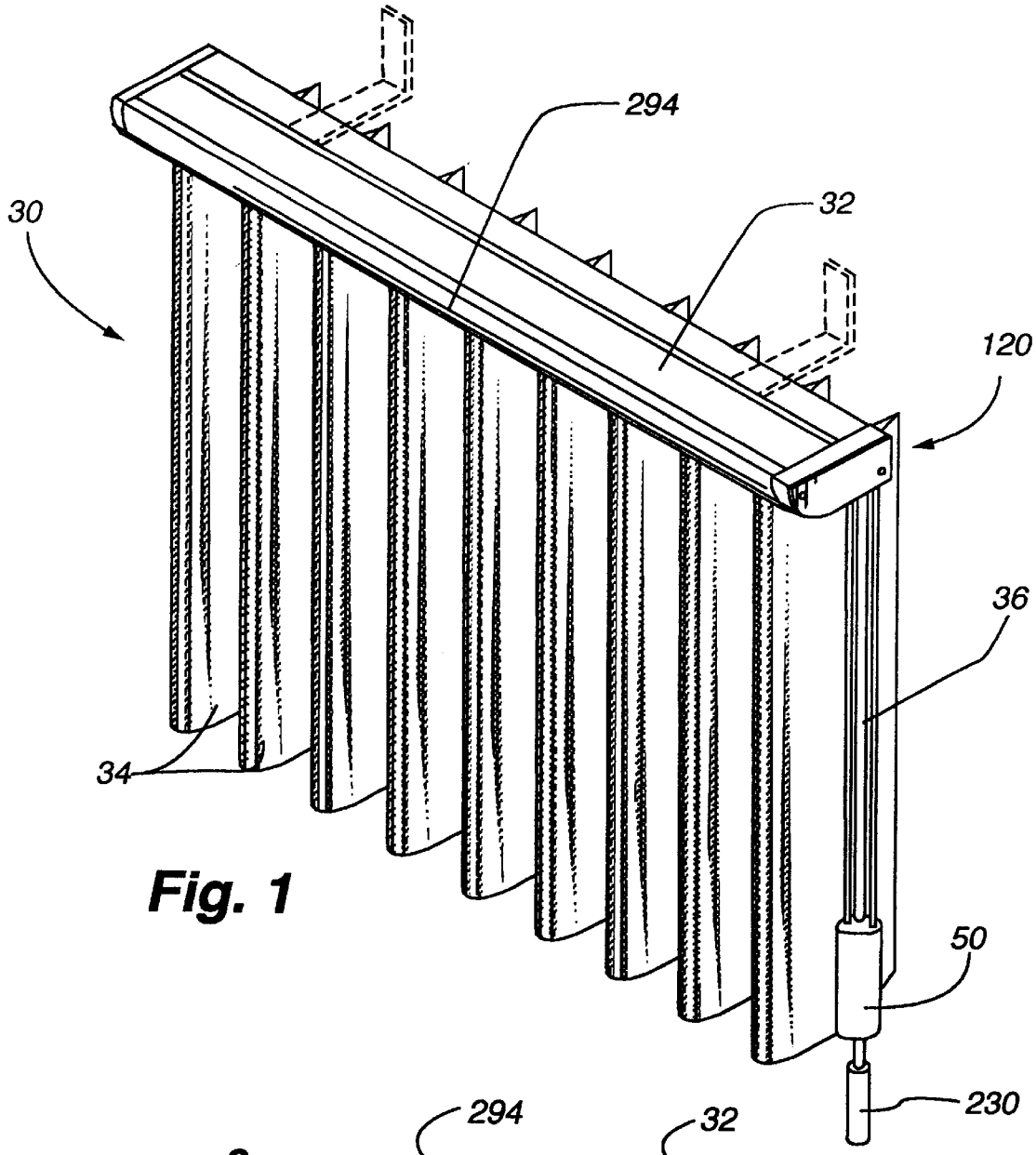
FIG. 1 is an isometric view of a vertical vane covering for an architectural opening incorporating the operating, control and suspension system of the present invention with mounting brackets shown in phantom lines.
Figure 2:
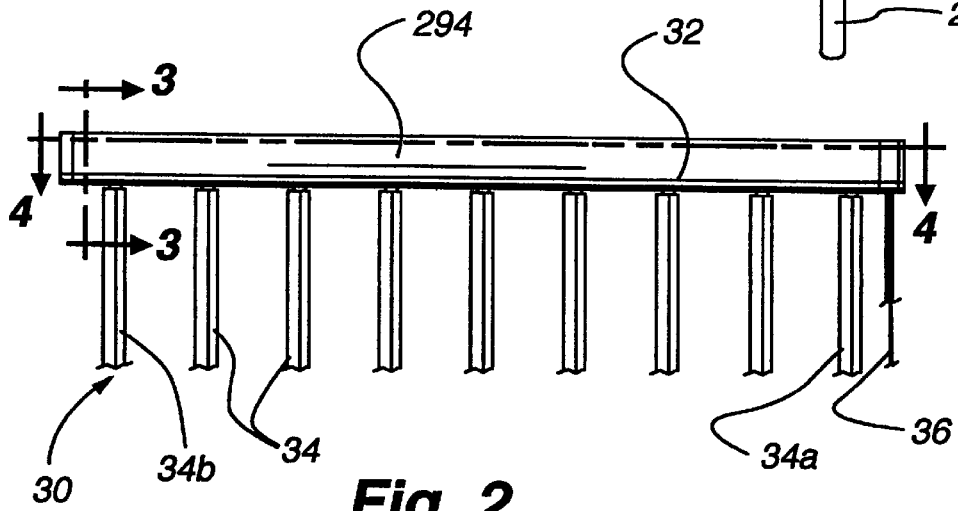
FIG. 2 is a fragmentary front elevation of the covering shown in FIG. 1 illustrating the head rail and the uppermost portion of the suspended vanes.

Referring first to FIGS. 1 and 2, a vertical vane covering 30 for an architectural opening (not shown) in accordance with the present invention is illustrated. The covering can be seen to include a head rail 32 from which is suspended a plurality of parallel vertical vanes 34 of tubular configuration and an operating or tilt wand 36 suspended from one end of the head rail for use in operating the covering. A covering of the type illustrated is movable between extended and retracted positions with the covering in the extended position of FIGS. 1 and 2 having the vanes 34 evenly distributed along the length of the head rail and across the width of the architectural opening. In the retracted position (FIG. 5), the vanes are gathered or horizontally stacked adjacent one or both ends of the head rail. A control system 38 for the covering (FIGS. 4 and 5) is operative for moving the vanes between the extended and retracted positions and also for pivoting each vane about a vertical longitudinal axis between open and closed positions. In the open position (FIGS. 1, 2, 4, 5 and 14 through 21), the vanes extend perpendicularly to the head rail and to the architectural opening in which the covering is mounted. In the closed position (not shown), the vanes are pivoted approximately 90 degrees so as to slightly overlap and substantially form a plane that is aligned with the length of the head rail and parallel with the architectural opening.

In accordance with the present invention, the new and improved control system 38 includes the head rail 32, carriers 40, a tilt rod 42, a pantograph 44 and a hanger pin 46 that suspend the vanes 34 from associated carriers. The head rail is itself uniquely designed to not only accommodate the working components of the control system but also to improve the combined aesthetics of the head rail and the suspended vanes. An operating system for the covering includes the tilt wand 36, a pull cord 48, and a coupler 50. The operating system has been designed to simplify the working components thereof and to efficiently interact with the control system in moving the vanes between the extended and retracted positions as well as the open and close positions.

The head rail 32, which is best seen in FIGS. 1 through 6, 8 and 9A, has an elongated hollow body having a front wall 52, bottom wall 54, top wall 56 and rear wall 58 which are integrally interconnected to define an opening 60 through the rear wall that extends the full length of the head rail for a purpose to be described later. The front wall has an upper portion 62 that is flat and vertical and a lower portion 64 that forms a 90 degree arc of a circle so as to be continuous with the upper portion and also with the bottom wall of the head rail which is flat. The rear wall extends vertically and perpendicularly to the bottom wall but has a height of only about one-third of the overall height of the head rail. The upper end of the rear wall is enlarged defining a downwardly directed shoulder 66 that confronts a channel 68 formed from an arm 70 of the rear wall that is reverse L-shaped cross-section. The channel 68 is therefore generally U-shaped but has the downwardly directed shoulder 66 overlying a portion thereof. At an intermediate location along the length of the bottom wall 54, an upstanding rib 72 is provided that is reverse F-shaped in cross-section. The reverse F-shaped rib defines upper 74 and lower 76 channels that are generally U-shaped in cross section but lying on their side so as to open toward the rear wall 58 of the head rail. The upper channel 74 also performs a function that will be described in more detail hereafter.

The top wall 56 projects rearwardly from the front wall and is spaced downwardly from the top edge of the front wall a short distance. The top wall projects rearwardly approximately five-sixths of the overall depth of the head rail and is provided with an enlarged head 78 on its rear most edge that is immediately adjacent to an upwardly opening shallow channel 80 formed in the top wall. The channel 80 and enlarged head 78 cooperate in defining a catch 81 that releasably receives a portion of a mounting bracket 82 as will be described hereafter. About one-third of the way along the top wall as it projects rearwardly from the front wall, an upstanding rib 84 that is of inverted L-shaped cross-section defines a rearwardly opening pocket 86 extending along the length of the head rail. The pocket 86 and the catch 81 cooperate with the bracket 82 used to mount the head rail 32 by having the forwardmost extent of the bracket protruding into the pocket 86. The bracket has a pocket 88 itself adapted to cooperate with and releasably receive the catch 81 on the rear edge of the top wall. The remainder of the mounting bracket will not be described in detail but suffice it to say that it is otherwise designed in a conventional way to be mounted on various types of support surfaces such as a window frame, a door frame or the like. The cooperation between the top wall of the head rail and the mounting bracket is such that the head rail can be easily releasably disposed on the bracket by allowing the forwardmost edge of the bracket to be inserted into the pocket 86 and then tilting the head rail so that the catch 81 on the rear end of the top wall is received in the pocket 88 in the bracket. A generally C-shaped channel 90 is formed on the lower surface of the top wall so that threaded fasteners can secure end caps 92 and 94 (FIG. 1) to opposite ends of the elongated hollow body of the head rail.

The control system 38 for the covering of the present invention is of the general type described in U.S. Pat. No. 5,819,833 which is of common ownership with the present application and that patent is hereby incorporated by reference. The control system, as mentioned, which is probably best seen in FIGS. 3 through 9 includes the plurality of carriers 40 that are slideably mounted on the tilt rod and within the elongated hollow body of the head rail for sliding movement along the length of the head rail and the overlying pantograph 44 that operably connects the carriers for directing their movement along the length of the head rail. The carriers protrude rearwardly through the opening 60 in the back of the head rail and suspend the vanes from a location rearwardly of the rear wall 58 of the head rail.

The carriers 40 per se are substantially identical to those described in detail in the afore-noted U.S. Pat. No. 5,819,833 and accordingly a detailed description thereof will not be repeated here. Suffice it to say that the carriers have a horizontal passage 96 therethrough for slideably and rotatably receiving the tilt rod 42 and also have a forwardly projecting lip 98 along a lower edge of the carrier as well as a downwardly projecting arm 100 approximately midway along the length of the carrier. The lip 98 and the arm 100 function as guide members and are received respectively in the rearwardly opening upper channel 74 of the reverse F-shaped rib and the upwardly opening channel 68 in the rear wall of the head rail which form guide tracks for the carriers. The carriers are therefore guided in their sliding movement along the length of the head rail by the channels and the tilt rod. As described in the afore-noted U.S. Pat. No. 5,819,833, each carrier 40 pivotally supports a hangar pin 46 (FIG. 9) from its rearwardmost end with each hangar pin having a pinion gear 102 thereon that cooperates with a rack 104 in the carrier that in turn is linearly driven by rotation of the tilt rod 42 in a manner clearly described in the aforenoted U.S. Pat. No. 5,819,833. The hangar pin in accordance with the present invention differs only slightly from the hangar pin in the afore noted patent in that the hangar pin in the present invention utilizes a different system for interconnecting a suspended vane 34 from the carrier. In the present invention, the hangar pin includes a pair of spaced depending legs 106 having catches 108 on their lower ends and wherein the legs are resilient and somewhat flexible toward and away from each other. The manner in which the legs are utilized to releasably connect a vane thereto will be described in more detail later.

Each carrier has an upstanding pin 109 for interconnection with the pantograph 44 in a manner as described in the aforenoted U.S. Pat. No. 5,819,833. The pantograph itself, is somewhat different, in that while including two sets of links 110 and 112 with the links in the first set being disposed parallel to each other and the links in the second set being disposed parallel to each other, the links in the second set 112 are shaped differently from the lengths 110 in the first set. The links in the second set are probably best seen in FIGS. 4, 5 and 9, to be of substantially trapizoidal configuration having a large end 114, a small end 116 and a pair of side edges 118 that converge toward each other toward the small end. Each link in the second set therefore has a large width at one end and a small width at the other end but adjacent links in the second set are oppositely mounted so that the direction of the converging side edges 118 is reversed for each adjacent link in the second set. The straight converging side edges of the links in the second set allow the links to be moved into closely adjacent relationships so that the vanes suspended from the carriers can be closely stacked at the end of the head rail in the retracted position of the covering and the close stacking is achieved without sacrificing strength in the links.

The present invention is being described in connection with a covering that utilizes a single pantograph 44 that moves a plurality of vertical vanes 34 from a horizontally stacked relationship at one side edge of the architectural opening to an even distribution across the architectural opening so that the vanes are evenly distributed along the length of the head rail when the covering is fully extended. It will be appreciated, however, that with simple modifications to the system a covering could be extended from opposite sides of the head rail toward the center of the head rail by utilizing two pantographs with each pantograph extending approximately half the length of the head rail when fully extended.

Figure 3:
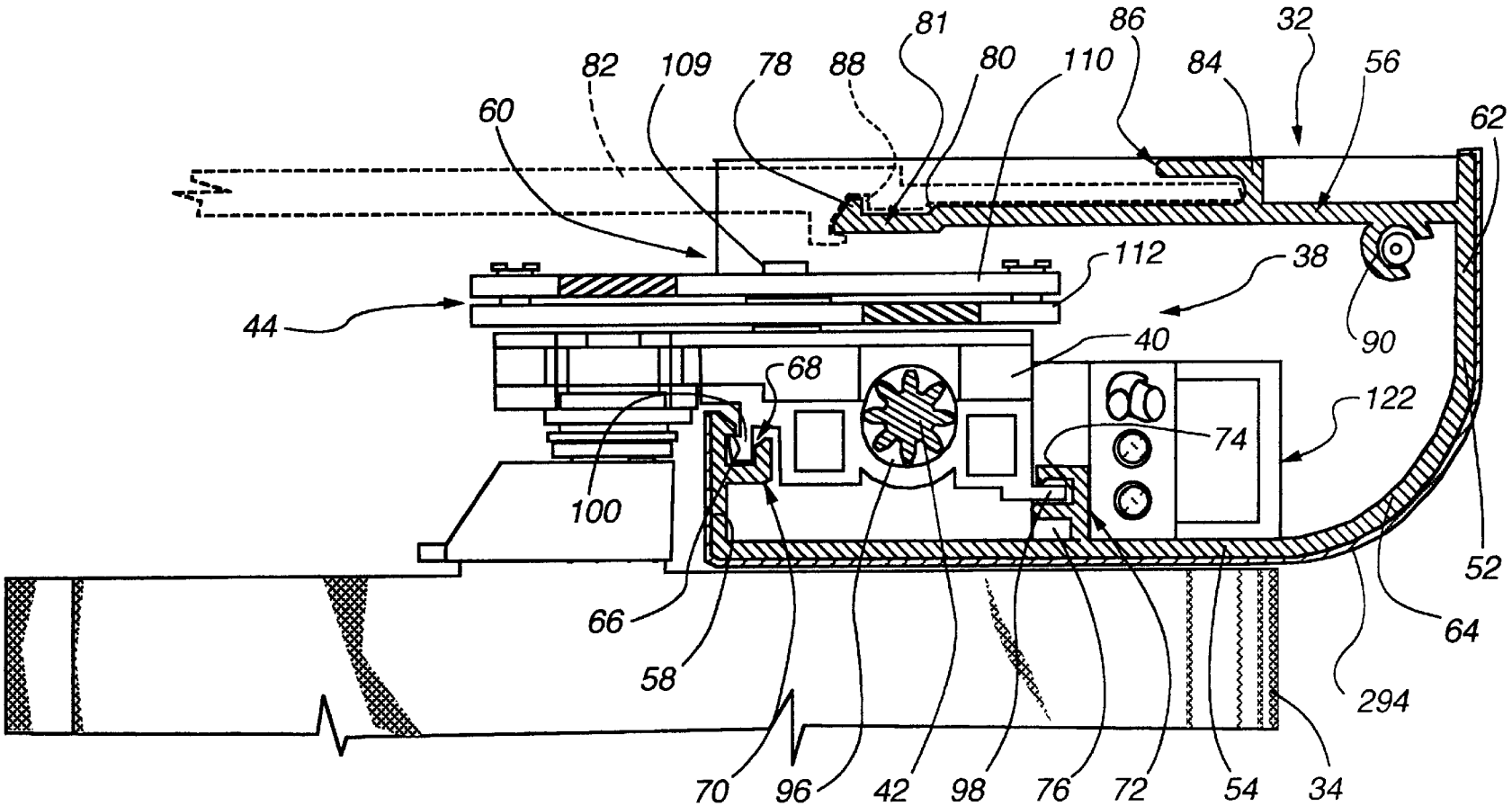
FIG. 3 is an enlarged section taken along line 3—3 of FIG. 2 with a mounting bracket shown in dashed lines.
Figure 4:
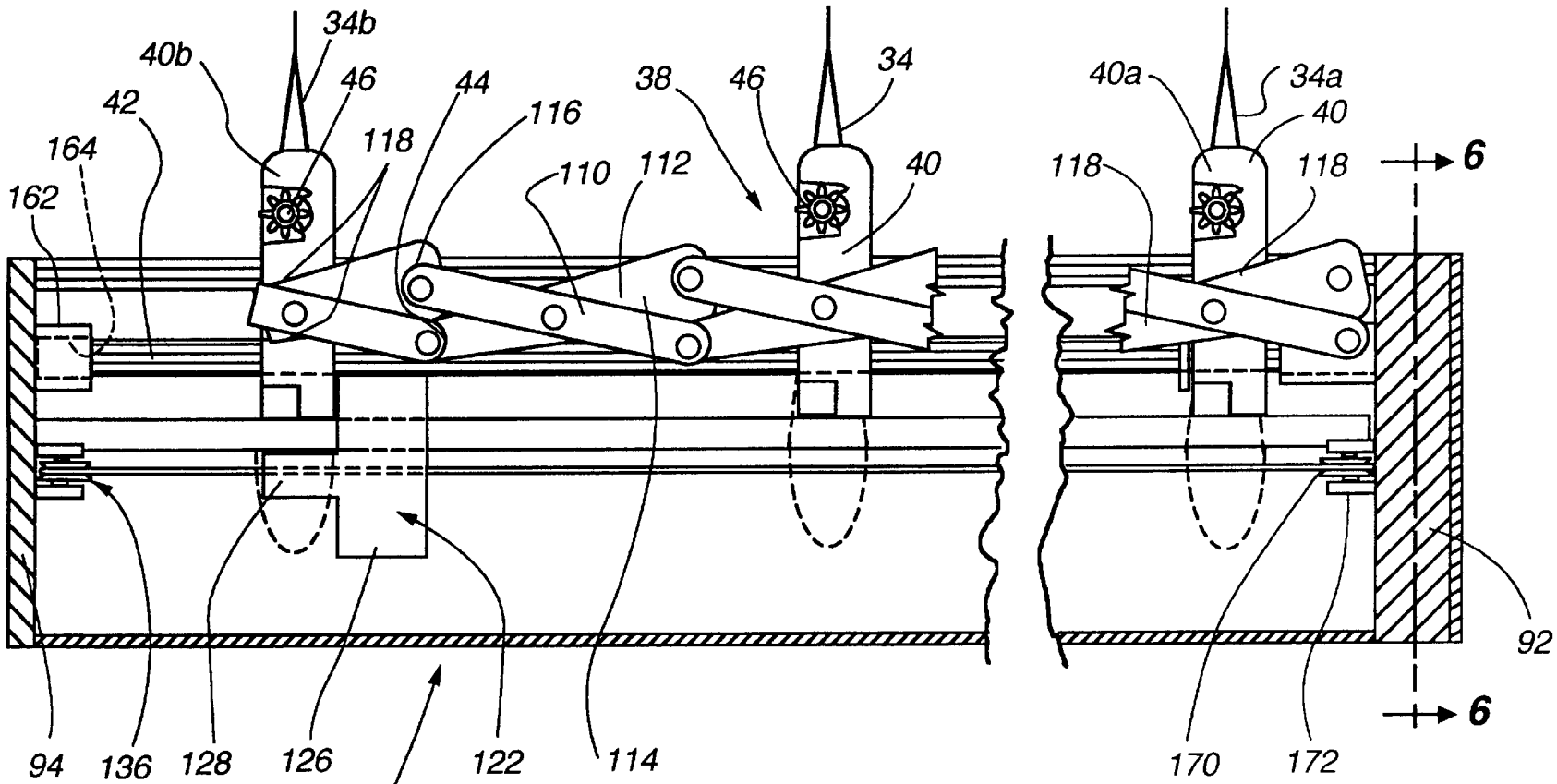
FIG. 4 is an enlarged fragmentary section taken along line 4—4 of FIG. 2 and with the covering in an extended condition.
Figure 5:
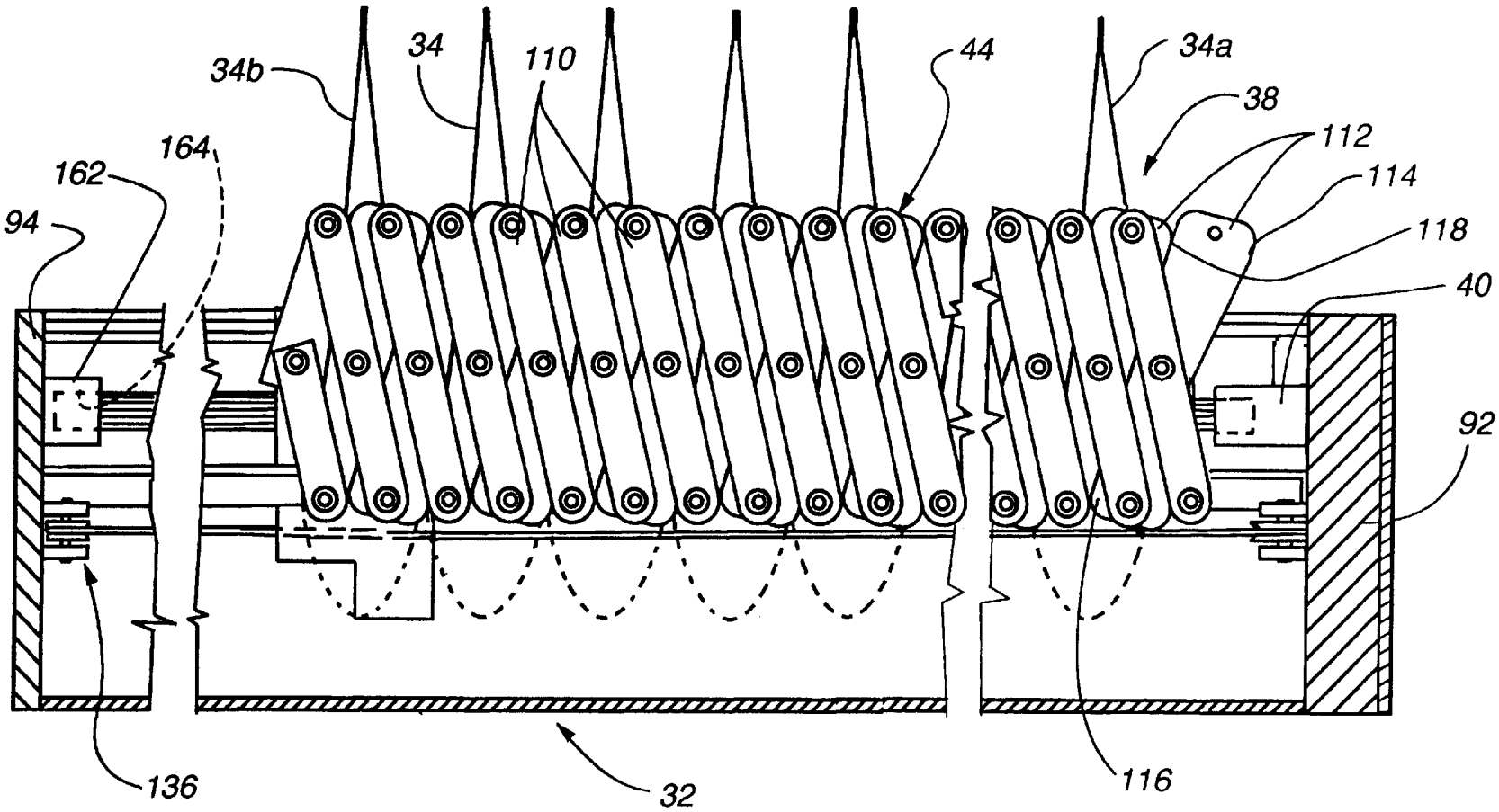
FIG. 5 is a section similar to FIG. 4 with the covering in a substantially retracted position.
Figure 7:
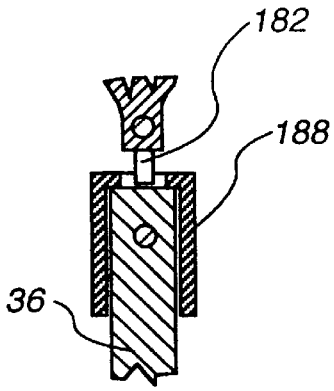
FIG. 7 is a section taken along line 7—7 of 6.

As can be appreciated by reference to FIGS. 4 and 5, the pantograph 44 and other components of the control system 38 for the covering of the present invention suspend a plurality of vertical vanes 34 that include an innermost or fixed end vane 34*a* positioned in a fixed location adjacent to a control end 120 of the head rail and a free end vane 34*b* that is positioned at the opposite end of the pantograph and is adapted to move the greatest distance along the length of the head rail when the covering is moved between extended and retracted positions. The fixed end vane is secured in position in a manner that will be described later while the free end vane is adapted to slide along the length of the head rail as with each of the remaining vanes but the free end vane is suspended from a free end carrier 40*b* that is operatively connected to a pull cord anchor block 122 as best seen in FIGS. 3 through 5, 9A and 13.

Figure 9:
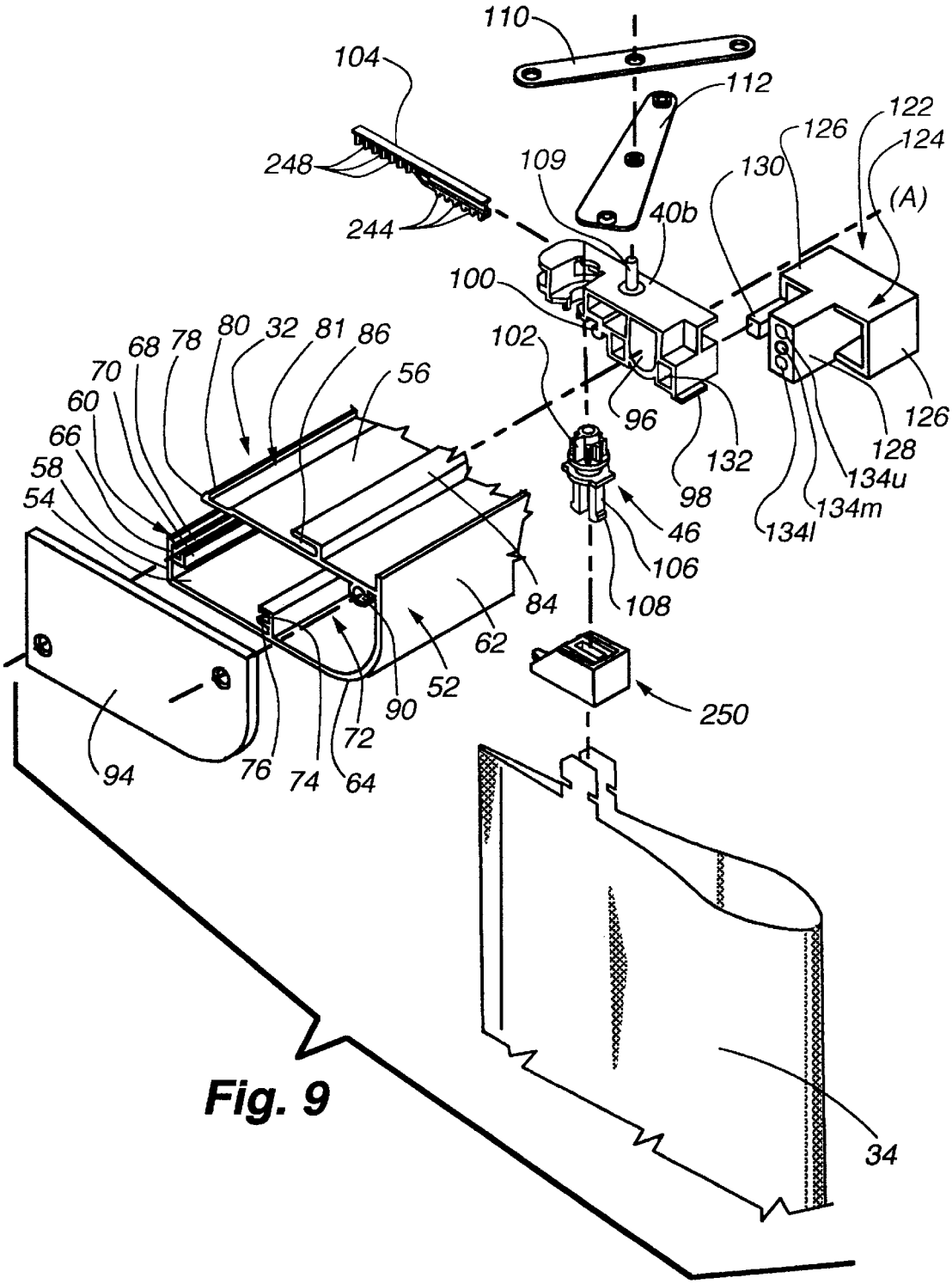
FIG. 9 is an exploded fragmentary isometric showing portions of the control system, the head rail, a vane and a suspension system.
Figure 9A:
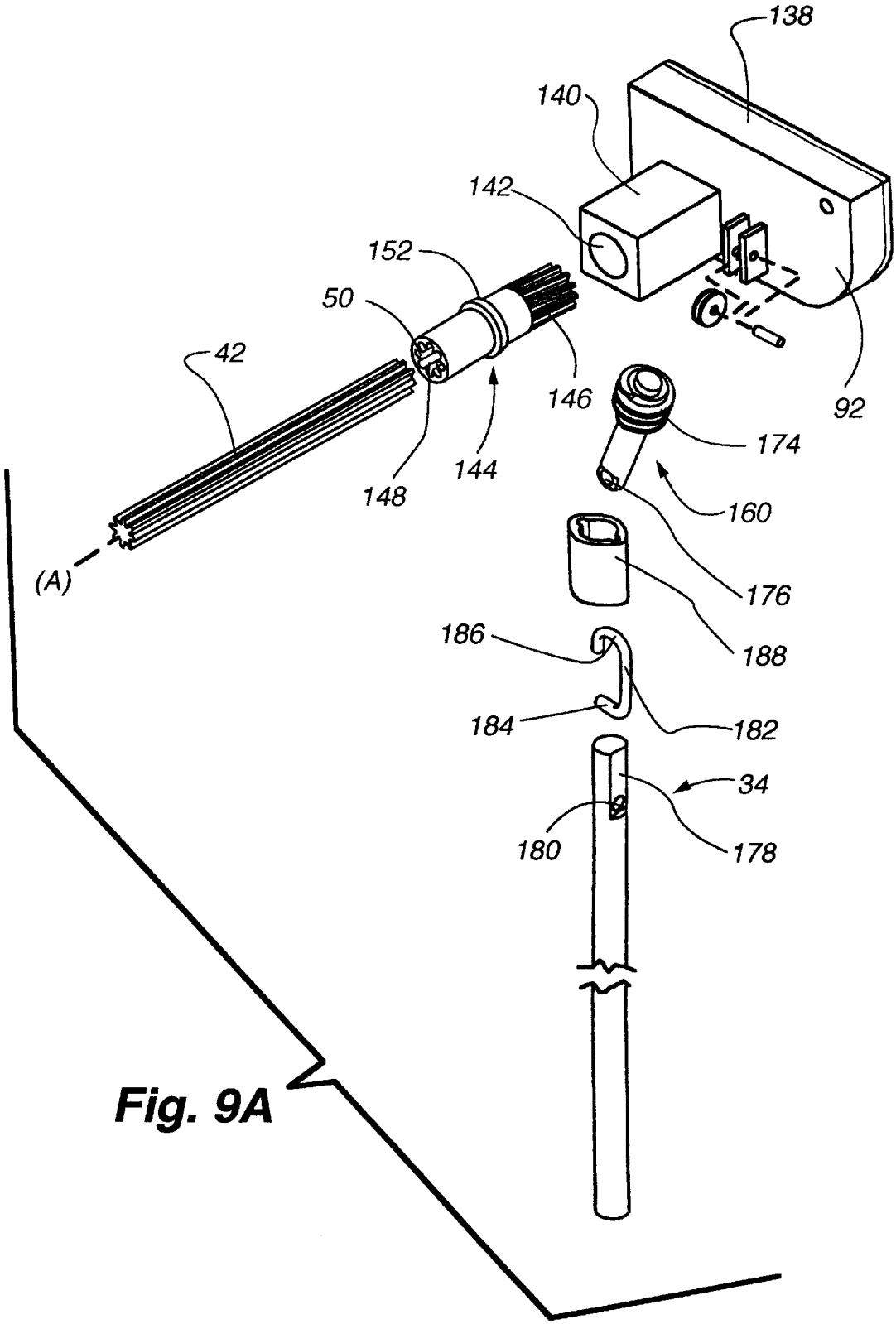
FIG. 9A is an exploded isometric view showing one end of the head rail with the tilt rod and tilt wand operably connected thereto.
Figure 11:
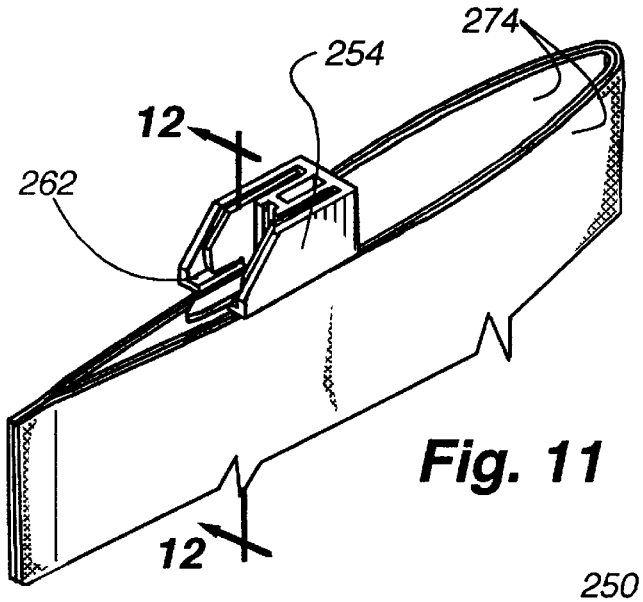
FIG. 11 is a fragmentary isometric view similar to FIG. 10 with the components in an assembled condition.

As probably best seen in FIG. 9, the pull cord anchor block 122 is secured to the free end carrier 40*b* so as to move in unison with the free end carrier and serve as an anchor for each end of the pull cord. The pull cord anchor block has a hollow main body 124 defined by a peripheral wall 126 and a transverse base 128 extending the full height of the hollow body but only about a quarter of the width of the hollow body at a longitudinally centered location in the hollow body. The base 128 extends in one direction away from the main body of the anchor block in parallel relationship with a securement block 130 that is also formed off the same side of the main body of the anchor block. The securement block is of square cross-section and is aligned with one end of the main body 124. The securement block is adapted to be tightly fitted into a complimentary square opening 132 found in the inner end of free end carrier 40*b*. The securement block is inserted into the complimentary opening 132 in the free end carrier and secured therein either through a tight friction fit or with the inclusion of a strong adhesive. With the securement block tightly received and thereby positively connected to the free end carrier, the pull cord anchor block 122 forms an inward extension therefrom toward the front wall 52 of the head rail.

The transverse base 128 of the pull cord anchor block has three horizontal passages 134*u*, 134*m* and 134*l* therethrough which are vertically aligned and adapted to receive a portion of the pull cord 48 used in the operation of the covering in a manner to be described. It should be appreciated that there is only one pull cord anchor block 122 utilized in the system and that the anchor block is secured to the free end carrier 40*b* so as to move in unison therewith. As will be appreciated with the description that follows, movement of the pull cord causes the free end vane 34*b*, through the anchor block, to move longitudinally of the head rail in a reciprocating manner and due to the interconnection of the various vanes and their associated carriers with the pantograph 44, the movement of the free end carrier 40*b* and its associated free end vane causes each of the other vanes to follow.

The head rail 32 has end caps 92 and 94 at each end thereof with one end cap 92 being identified as the control end cap and the other end cap 94 as the idle end cap. The control end cap 92 houses various control and operational mechanisms for manipulating the covering while the idle end cap 94 serves only as a support for one end of the tilt rod 42 and for a first idler pulley 136 around which the pull cord 48 passes.

The control end cap 92 which can best be seen in FIGS. 4, 5, 6, 8, 9A and 13, is contoured so as to have the same cross sectional configuration as the head rail 32 and is secured to one end of the head rail with a fastener that is passed through the control end cap and into an open end of the C shaped channel 90 on the top wall 56 of the head rail. The control end cap has a main body portion 138 which abuts the associated end of the head rail and a lower horizontal extension portion 140 that protrudes a short distance into the open end of the head rail contiguous with the bottom wall 54 of the head rail. The extension portion 140 has a cylindrical recess 142 therethrough which terminates in the main body portion 138 of the control end cap. The cylindrical recess 142 rotatively receives and supports a gear coupler 144 having a pinion gear 146 on one end and a recessed axial receptacle 148 at the opposite end with the receptacle opening through the opposite end and having a plurality of longitudinally extending grooves forming a star shaped interior wall 150 of the receptacle. The star shaped interior wall is complimentary with the cross-sectional shape of the tilt rod 42 with the tilt rod thereby being an elongated pinion gear such that when the end of the tilt rod 42 is inserted in the star shaped receptacle 150, the gear coupler is caused to rotate in unison with the tilt rod. The gear coupler has an annular circumferential flange 152 at approximately its longitudinal center which is spaced from the innermost end of the extension portion 140 of the control end cap for a reason to be explained hereafter.

When the gear coupler 144 is inserted into the cylindrical recess 142, the pinion gear 146 thereon is transversely aligned with a cavity 154 formed in the main body 138 of the control end cap with the cavity being of cylindrical configuration and continuous through a smaller diameter axially aligned cylindrical passage 156 through the bottom wall 158 of the control end cap. The smaller diameter cylindrical passage 156 and the cylindrical cavity 154 extend along an axis that forms an acute angle with vertical (i.e., approximately 20 degrees) and the cylindrical passage 156 is coaxial with the cylindrical cavity 154 to rotatably receive a drive connector 160 as will be explained in more detail later. As is best appreciated in FIGS. 4, 5 and 8, a fixed end carrier 40*a*, associated with the fixed end vane 30*a*, is disposed between the annular flange 152 on the gear coupler 144 and the innermost end of the extension 140 of the control end cap so that when the tilt rod and gear coupler are operably connected and positioned in place, the fixed end carrier 40*a* remains at a fixed location relative to the head rail and does not move longitudinally of the head rail with the remaining carriers when the covering is moved between extended and retracted positions.

The idle end cap 94 is also configured to have the same cross-sectional configuration as the head rail 32 and abuts the opposite end of the head rail from the control end cap 92. It too is fixed in position by a fastener that extends through the idle end cap and into the opposite open end of the C-shaped channel 90 formed on the top wall of the head rail in threaded engagement therewith. When mounted on the end of the head rail, the idle end cap has a cylindrical hub 162 with a cylindrical recess 164 therein that is aligned with the cylindrical recess 142 in the control end cap so that it is adapted to rotatably receive and support the opposite of the tilt rod 42.

The tilt rod 42 is of a predetermined length relative to the head rail so that when the end caps are positioned on the ends of the head rail, one end of the tilt rod is supported in the hub 162 of the idle end cap and the opposite end in the gear coupler 144 thereby holding the gear coupler in its rotatably seated relationship with the cylindrical recess 142 in the control end cap. This, of course, captures the fixed end carrier 40a between the control end cap and the annular flange 152 on the gear coupler to prevent it from moving longitudinally of the head rail with the other carriers during operation of the covering.

Figure 6:
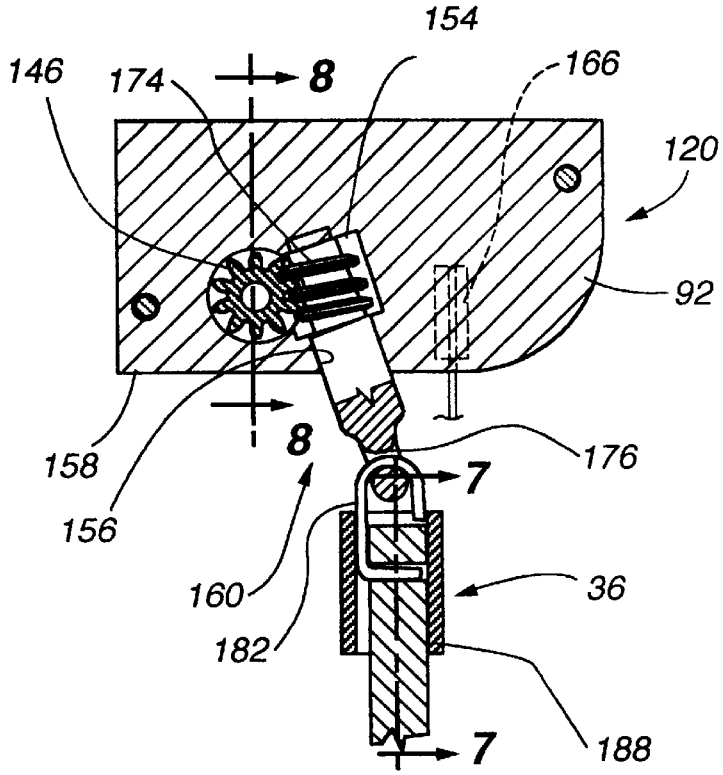
FIG. 6 is a section taken along line 6—6 of FIG. 4.
Figure 8:
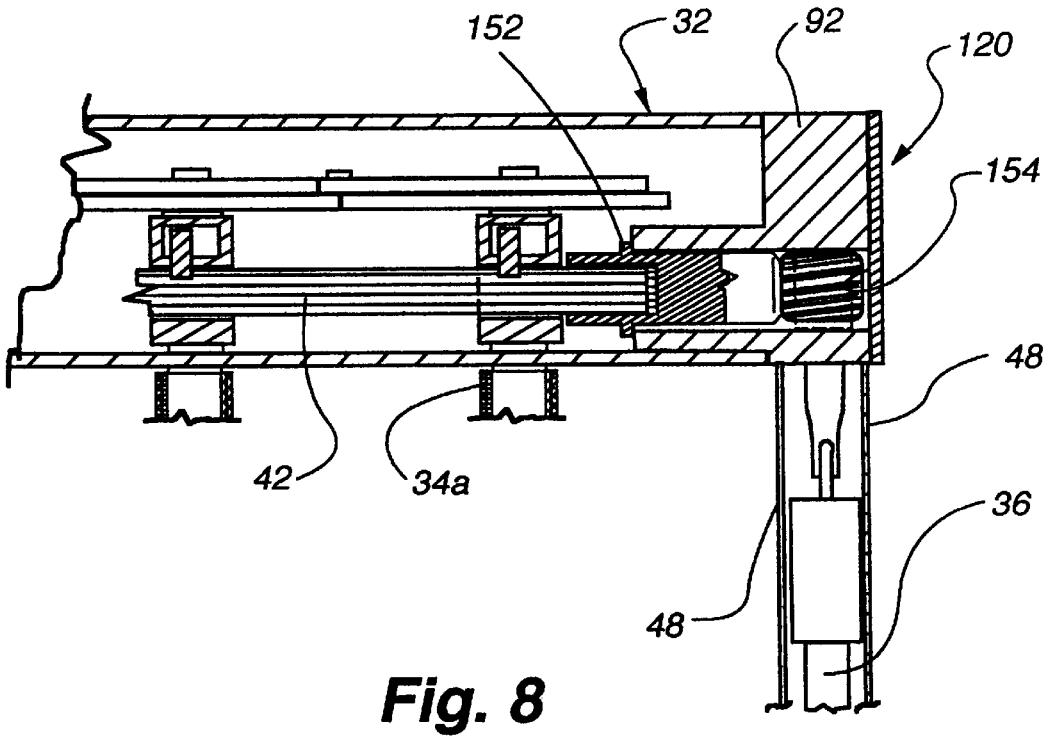
FIG. 8 is a section taken along line 8—8 of FIG. 7.
Figure 13:
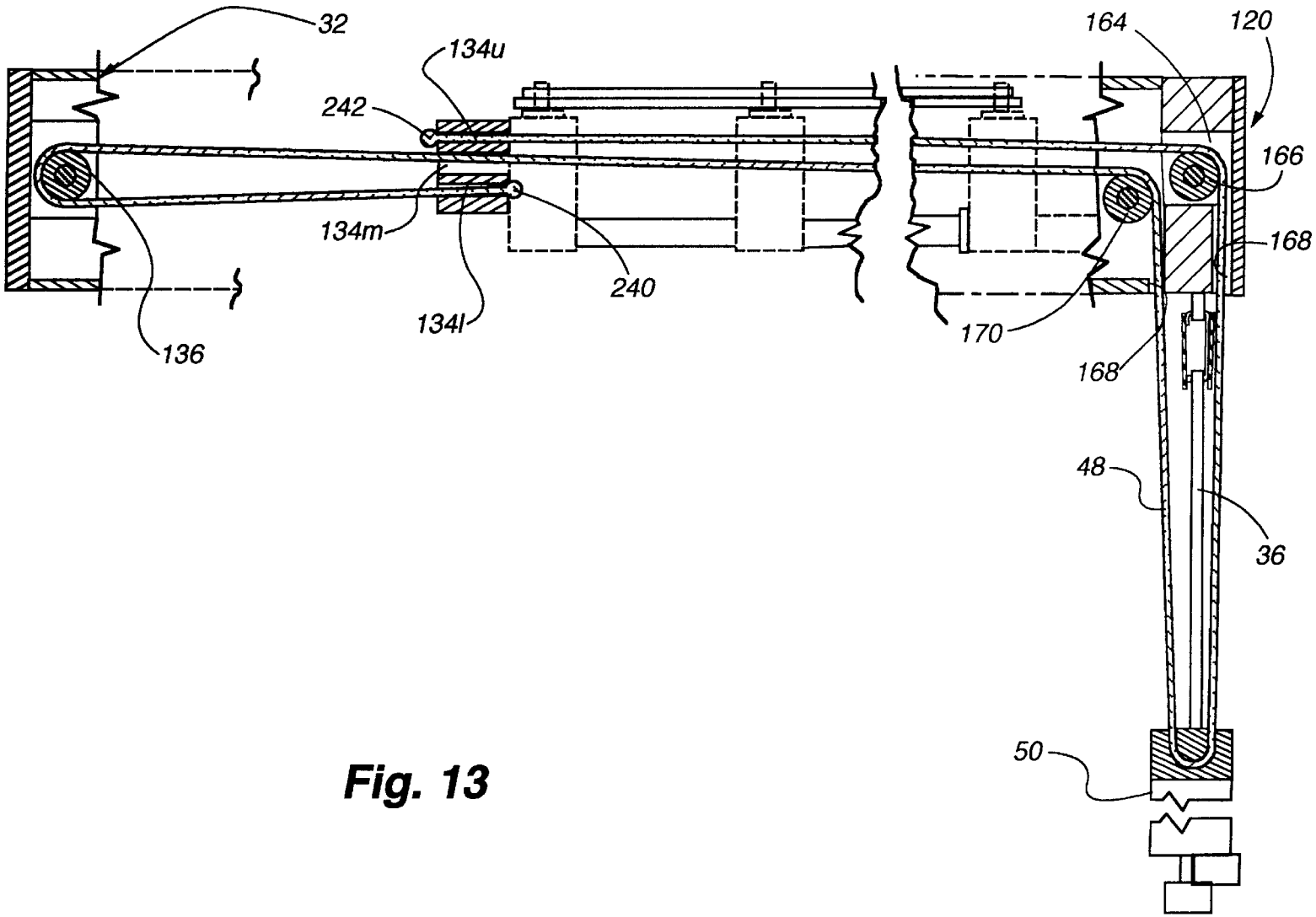
FIG. 13 is a fragmentary diagrammatic view showing the operating system of the present invention.

As probably best seen in FIGS. 6 and 13, the control end cap 92 further has a vertically oriented, inwardly opening rectangular recess 164 formed therein that is laterally offset from the cylindrical recess 142 for the gear coupler with the rectangular recess rotatably supporting a second idler pulley 166 on a horizontally disposed axle. A pair of circular passageways 168 extend in parallel but spaced relationship from the rectangular recess through the bottom wall 158 of the control end cap to receive and guide the pull cord 48 in a manner to be described later.

A third idler pulley 170 is mounted for rotation about a horizontal axis on a pair of brackets 172 that protrude inwardly from the control end cap 92 in longitudinal alignment with the second idler pulley 166 but at a slightly lower elevation. The second and third idler pulleys are adapted to guide the pull cord 48 as will be explained later. As is best seen in FIG. 6, due to the angled mounting of the drive connector 160, its lower end is in substantially vertical alignment with the second idler pulley 166 and positioned between the spaced, circular passageways 168 communicating with the rectangular recess 164 for the second idler pulley so that the passageways 168 and the lower end of the drive connector are all substantially positioned within a vertical plane that extends longitudinally of the head rail.

The tilt rod 42 is rotated about its longitudinal axis by the drive connector 160 which, as mentioned previously, is positioned within the cylindrical cavity 154 and the small diameter cylindrical passage 156 in the control end cap 92 immediately adjacent to the end of the gear coupler 144 that operatively supports the tilt rod. The drive connector has an external worm gear 174 on its uppermost end that is in driving engagement with the pinion gear 146 on the gear coupler. The drive connector protrudes at an acute angle through the bottom wall 158 of the control end cap so that its lowermost end, as mentioned previously, is in alignment with the second idler pulley 166.

The lower end of the drive connector 160 has a circular hole 176 therethrough to facilitate its operative connection to the tilt wand 36. The tilt wand as best seen in FIGS. 1, 6 and 9*b* is an elongated cylindrical rod having a flat recessed axially extending surface 178 at its uppermost end and a transverse aperture 180 therethrough. A connector pin 182, which is substantially C-shaped in configuration, has a horizontal lower leg 184 that projects into the transverse aperture 180 and a hook shaped upper end 186 that passes through the hole 176 in the lower end of the drive connector 160. Before connecting the C-shaped connector pin to the drive connector and the tilt wand, however, an oval resilient collar 188 is slid over the upper end of the tilt wand so as to be beneath the transverse aperture 180. Once the C-shaped connector pin has been connected to the tilt wand and the drive connector, the collar is slid upwardly and due to its resilience remains in place in surrounding overlying relationship with the lower end of the C-shaped connector pin to hold it in position and in its operative connection with the tilt wand. It will be appreciated that rotational movement of the tilt wand about its longitudinal axis will cause the drive connector to rotate in unison about its longitudinal axis even though they are not axially aligned. Rotational movement of the drive connector in turn rotates the tilt rod 42 in unison about its longitudinal axis through the interfacing of the worm gear 174 on the drive connector with the pinion gear 146 on the gear coupler and the engagement of the tilt wand in the star-shaped axial receptical 148 of the gear coupler. Rotational movement of the tilt wand about its longitudinal axis as mentioned previously and as will be described in more detail later causes each vane 34 to pivot about an associated vertical axis.

Figure 23:
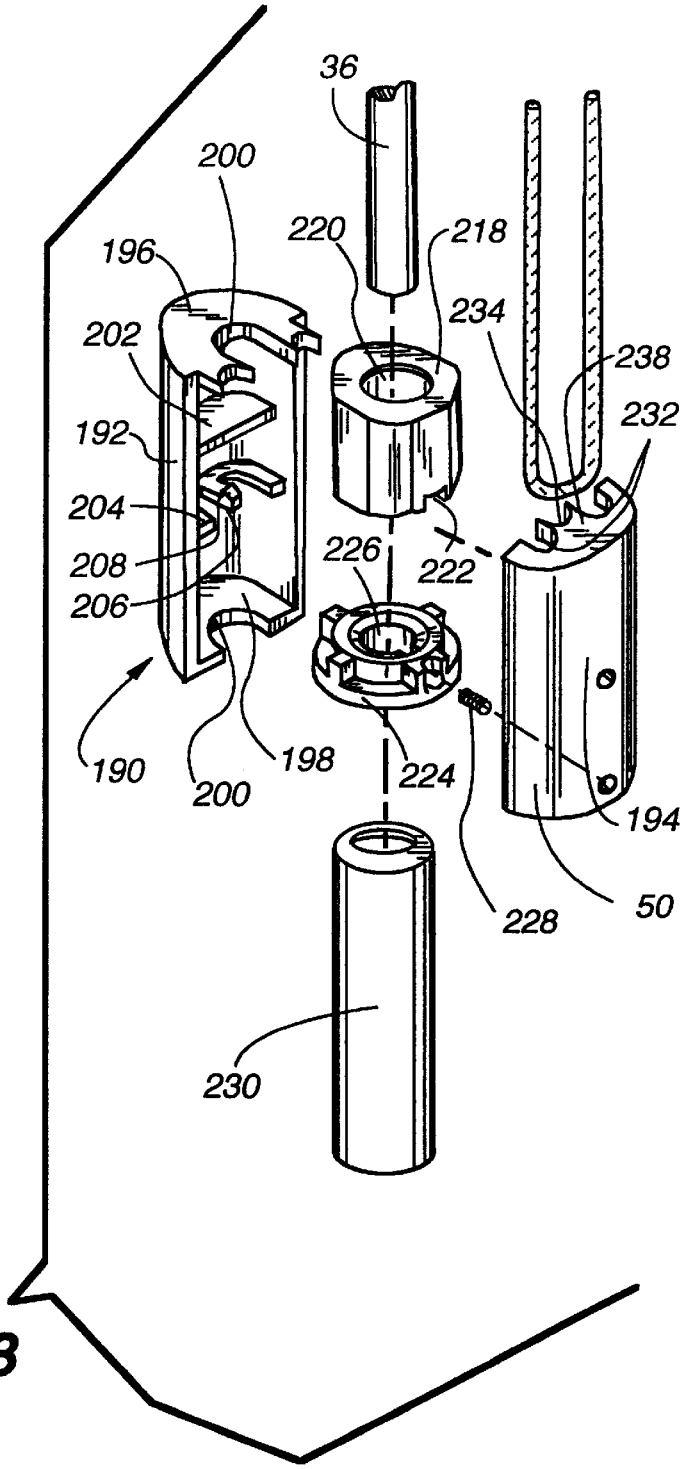
FIG. 23 is a fragmentary exploded view of the components illustrated in FIG. 22.

The tilt wand 36 also has the coupler 50 mounted thereon which serves as a sliding anchor for a lower run of the pull cord 48. The coupler, as best seen in FIGS. 1 and 22–26, has an outer shell 190 comprised of a large segment 192 and a small segment 194 that are interfaced and releasably interconnected to confine the inner components of the coupler. The large segment 192 of the shell as best seen in FIG. 23, has a top wall 196, a bottom wall 198 and arcuate cutouts 200 in the top wall and bottom wall with the cutouts being of slightly larger diameter than the diameter of the tilt wand so that the tilt wand can be rotatably received within the cutouts. A horizontal upper shelf or partition 202 is formed in the larger segment at a location about a quarter of the way along the height of the segment from the top wall 196. At about the midpoint of the height of the larger segment, a support shelf 204 is provided that is parallel with the upper shelf 202. The support shelf has a flexible finger 206 with a catch 208 on its distal end that protrudes toward the small segment 194 of the shell.

Figure 24:
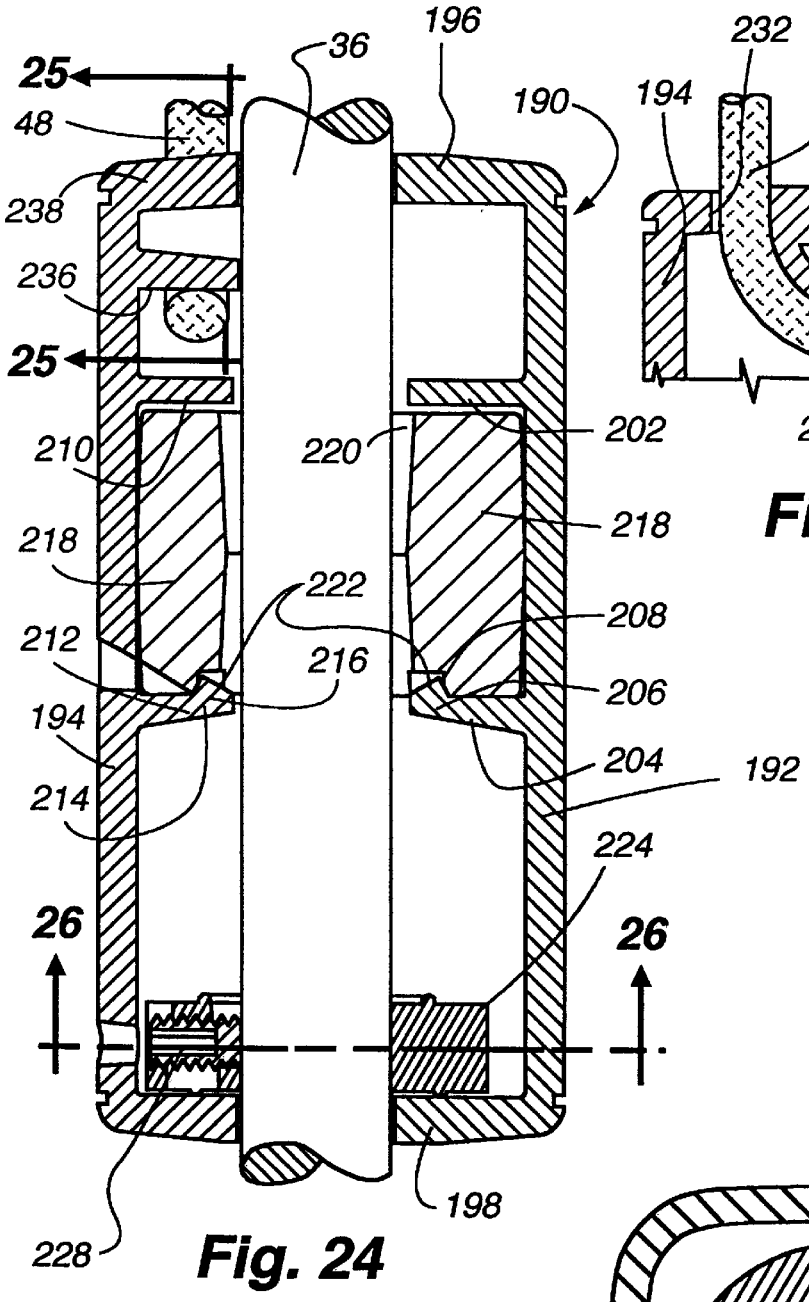
FIG. 24 is an enlarged fragmentary section taken along line 24—24 of FIG. 22.

The small segment 194 of the shell has a similar upper shelf or partition 210 and support shelf 212 with the support shelf also having a flexible finger 214 with a catch 216 on its distal end as is best seen in FIG. 24. When the segments of the shell are positioned in abutting and confronting relationship so as to define the entire shell 190, the upper shelf and support shelf of each shell segment are in horizontal confronting alignment and spaced from each other a distance that is slightly greater than the diameter of the tilt wand 36. The segments 192 and 194 of the shell are releasably held together by an anchor collar 218 that conforms in cross-sectional configuration to the cross-sectional configuration of the assembled shell 190 and is adapted to be seated between the confronting upper shelves and support shelves of the shell segments when the segments are positioned in confronting and abutting relationship. The anchor collar has a vertical cylindrical passageway 220 therethrough adapted to rotatably receive the tilt wand with the diameter of the passageway 220 being slightly larger than the diameter of the tilt wand. Notches 222 are provided in the lower end of the collar in alignment with the flexible fingers 206 and 214 of the support shelves and such that the catches 208 and 216 on the ends of the flexible fingers can be releasably connected to the notches in the anchor collar when the two segments of the shell (shelf?) are moved into confronting relationship with the collar disposed between the upper shelves and support shelves of the shell segments.

Before joining the shell segments 192 and 194 to the anchor collar 218, however, an anchor sleeve 224 is positioned on the tilt wand 36 beneath the anchor collar. The anchor sleeve 224 also has a cylindrical passageway 226 therethrough that is of slightly larger diameter than the tilt wand but the anchor sleeve is secured to the tilt wand at a predetermined location with a set screw 228 that is threaded radially through the anchor sleeve and into compressive engagement with the tilt wand. The anchor sleeve is therefore positively positioned along the length of the tilt wand so that it is rotatably disposed within a chamber defined between the lower wall of each shell segment 192 and 194 and the support shelf of each segment. The height of the anchor sleeve is less than the axial distance between the lower wall and the support shelf of each shell segment so that the anchor sleeve is free to move axially of the coupler a small distance to provide some axial play between the coupler and the tilt wand. It will be appreciated, however, that the tilt wand is free to rotate within the coupler.

To facilitate rotation of the tilt wand within the coupler, a rubber sleeve 230 can be slid onto the lower end of the tilt wand 36 with the rubber sleeve providing a good gripping surface for an operator of the tilt wand.

Figure 25:
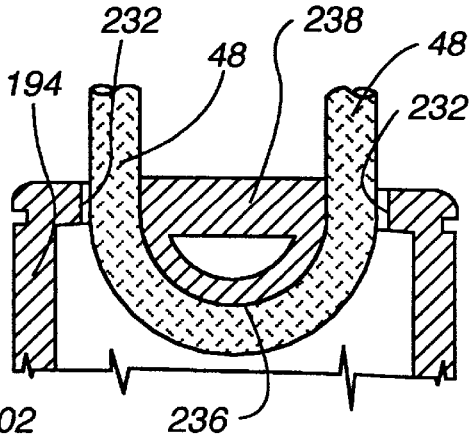
FIG. 25 is an enlarged fragmentary section taken along line 25—25 of FIG. 24.
Figure 26:
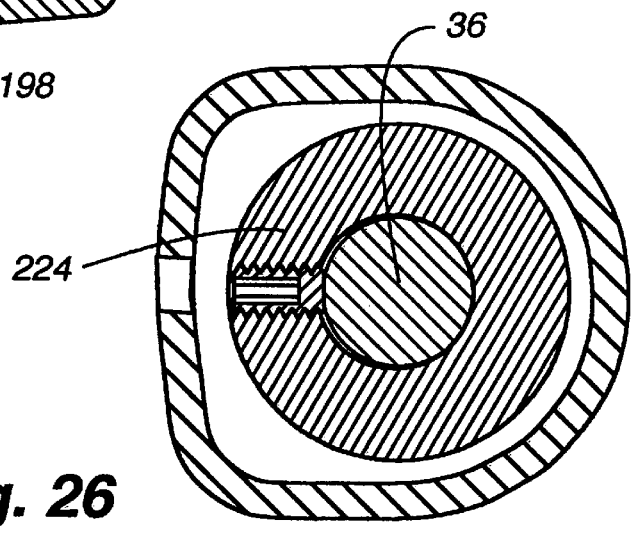
FIG. 26 is a section taken along line 26—26 of FIG. 24.

The smaller shell segment 194 has a pair of spaced arcuate notches 232 formed in its top wall on opposite sides of a cutout 234 for the tilt wand. The notches 232 are adapted to slidably receive the pull cord 48. The notches are in continuous alignment with a semi-circular slide surface 236 formed on the lower surface of the top wall 238 of the small segment 194 so that the pull cord can extend through the notches 232 and around the semi-circular slide surface as illustrated in FIG. 25. Of course, the pull cord is positioned in the notches and around the slide surface before the two segments of the shell are interconnected as described above.

It will, therefore, be appreciated that once the pull cord 48 has been properly positioned in the coupler 50 and the coupler properly positioned and secured around the tilt wand 36 in rotatable relationship therewith, an operator of the control system for the covering of the present invention can hold the coupler in one hand and rotate the tilt wand in another. As mentioned previously, rotation of the tilt wand 42 causes the tilt rod to rotate about its longitudinal axis within the head rail thereby pivoting the vanes 34 about associated vertical axes in a manner to be described later.

The pull cord 48 is utilized to move the carriers within the head rail along the length of the head rail but does so through the cooperation of the pantograph 44 which as mentioned previously operably interconnects the carriers 40 associated with each of the vanes 34 in the covering. The pull cord itself is a non-extensible cord of a predetermined length that has its opposite ends anchored to the pull cord anchor block 122. As best seen in FIG. 13, it will be appreciated that a first end 240 of the pull cord is extended through the lowermost one **134*l* of the three passages through the pull cord anchor block and a knot is tied in the end 240 of the cord on the side of the anchor block that is closest to the control end cap 92. The cord projects in the opposite direction away from the pull cord anchor block and extends around the first pull cord idler pulley 136 and then returns toward the control end cap and passes freely through the middle passage 134*m* of the pull cord anchor block. When the pull cord reaches the control end cap 92, it passes around the third idler pulley 170 and then downwardly through one of the passageways 168 in the control end cap and subsequently into and out of the coupler 50 while passing along the semi-circular slide surface 236. The control cord then extends upwardly into the control end cap through the other passageway 168 and around the second idler pulley 166 before again extending horizontally along the head rail until it is passed through the uppermost passage 134*u* through the pull cord anchor block and is secured thereto by knotting the second end 242** of the cord.

It will be appreciated with this arrangement that an operator of the system can grip one or the other vertical runs of the pull cord that extend on opposite sides of the tilt wand 36 and by pulling one or the other runs, cause the pull cord anchor block 122 and thus the free end carrier **40*b* to which it is attached to move horizontally along the length of the head rail in one direction or the other. Of course, by pulling the run of the pull cord that is on the right of the tilt wand, as viewed in FIG. 13, in a downward direction, the free end carrier is caused to be moved to the right in the head rail toward the control end cap and in doing so causes the pantograph 44 to retract or collapse thereby drawing each of the carriers 40 to which it is connected into a closely stacked relationship adjacent to the right end of the head rail. Oppositely, if the vertical run of the pull cord that is on the left of the tilt wand, as viewed in FIG. 13, is pulled downwardly, the pull cord anchor block is moved to the left pulling the free end carrier to which it is secured also to the left and the extreme movement of the free end carrier in this direction causes the vane 34** connected to the free end carrier to be moved adjacent to the left end of the head rail. Due to the operation of the pantograph, the remaining carriers and suspended vanes are evenly distributed along the length of the head rail and thus across the architectural opening adjacent which the head rail is mounted.

Referring to FIG. 9, and to the disclosure in the aforenoted U.S. Pat. No. 5,819,833, the tilt rod 42 extends horizontally along the length of the head rail 32 and in doing so passes through the aligned passages 96 in each of the carriers 40 so as to be freely slidable and rotatable therein. The tilt rod, as mentioned previously, is an elongated pinion gear with longitudinally extending and radiating teeth. The teeth are aligned with a first linear set of teeth 244 in the rack 104 that is slidably mounted within each carrier so that rotation of the tilt rod effects linear movement of the rack in a horizontal direction aligned with its length. A second linear set of teeth 248 in the rack 104 are operatively engaged with the pinion gear 102 on the top of an associated hangar pin 46 so that linear movement of the rack causes the hangar pin to pivot about its vertical axis. The hangar pins support the vanes 34 with a unique connector clip 250 such that pivotal movement of the hangar pin 46 about its vertical axis causes the associated vane to also pivot about the same axis. It will therefore be appreciated that rotation of the tilt wand in turn causes the tilt rod to rotate in unison therewith simultaneously causing the hangar pins to pivot the vanes.

From the above, it can be appreciated that the operation of the covering of the present invention is controlled by the operating system that includes the tilt wand, the coupler and the pull cord associated therewith. As mentioned previously, rotation of the tilt wand causes the vanes to pivot about a longitudinal vertical axis so that they can be moved between open and closed positions and movement of the pull cord in one direction or the other slides the carriers and their associated vanes along the length of the head rail between extended and retracted positions of the covering.

It should also be noted that the tension in the pull cord can be adjusted by appropriate positioning of the coupler 50 along the length of the tilt wand. By creating some tension in the pull cord, the vertical runs of the pull cord along the sides of the tilt wand are fairly closely spaced and it is difficult for a child to get an arm, leg or neck between the runs of the cord which has traditionally been a problem with conventional pull cord systems where there is a large hanging loop at the end of the head rail in which a child's arm, leg or neck can be easily caught.

The connector clip 250 for connecting a vane to a hangar pin 46 of an associated carrier is best seen in FIGS. 10, 11, 12 and 12A to be of generally U-shaped cross-section having a base plate 252 with two perpendicular side plates 254. The clip is positioned so that the base plate 252 forms a vertical wall and the side plates are also vertical walls perpendicular to the base plate. The side plates have a lower edge 256 extending the full length of the clip, a top edge 258 that extends approximately two-thirds the length of the clip and a beveled edge 260 extending substantially between the top edge and the bottom edge. A lip 262 protrudes inwardly from the lower edge of each plate 254 defining a space therebetween. The lips 262 extend horizontally and along the lower edge 256 of each side plate for a distance that is approximately a third the length of the clip. Corresponding lips 266 protrude inwardly along the lower edge of each side plate adjacent to the base plate 252 of the clip but these lips are not quite as long as the lips 262 at the opposite end of the side walls. An H-shaped projection 268 is formed off of the base plate and extends in parallel spaced relationship from the side plates of the clip. A vertical, rectangularly shaped passageway 270 is defined between the H-shaped projection and the base of the clip and spaces 272 are defined between the H-shaped projection and each side plate. The passageway 270 between the H-shaped projection and the base is adapted to receive the resilient legs 106 on a hangar pin 46 which can be compressed toward each other and inserted through the passageway until the catches 108 on the lower ends of the resilient legs spring out beneath the clip so as to releasably suspend the clip from the hangar pin.

Figure 10:
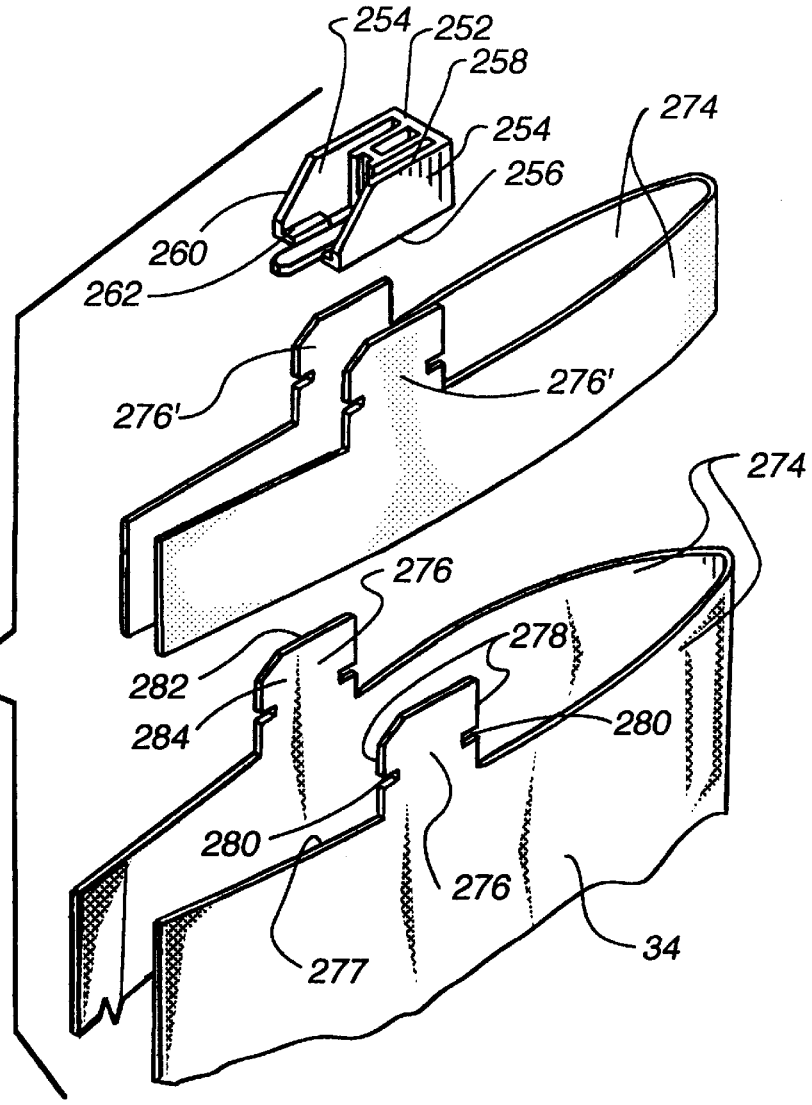
FIG. 10 is an exploded fragmentary isometric view showing the upper end of a vane and the improved clip of the present invention for suspending the vane from a carrier in the control system.
Figure 12:
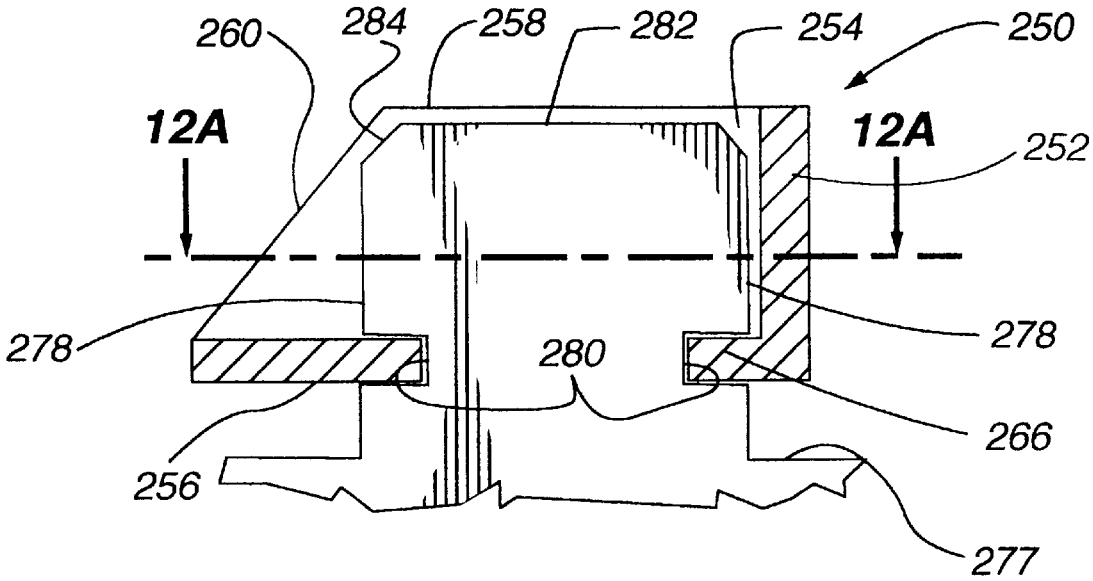
FIG. 12 is an enlarged fragmentary section taken along line 12—12 of FIG. 11.
Figure 12A:
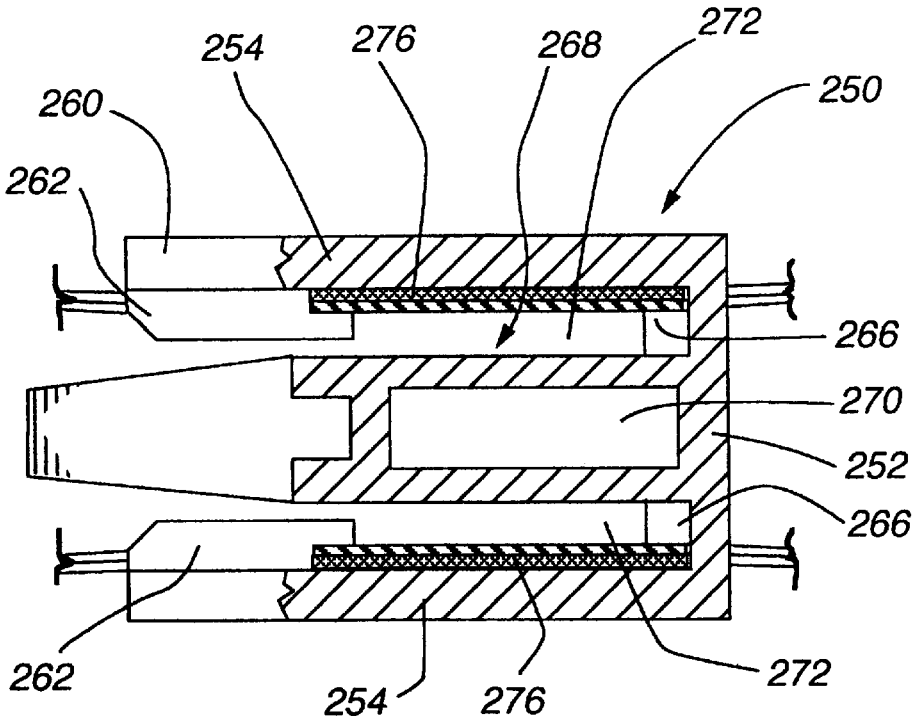
FIG. 12A is a section taken along line 12A—12A of FIG. 12.

The clip 250 is uniquely designed to not only suspend a vane from a hanger pin 46 but to retain the vane in its tubular configuration. As best seen in FIG. 10, each vane 34 has two side walls 274 that are spaced from each other to define the tubular configuration of the vane. Each side wall has a tab 276 projecting upwardly from a top edge 277 of the vane with the tabs being identical. Each tab has a pair of vertical edges 278 in which are formed horizontally aligned notches or catch locations 280 and the top edge of each tab has a horizontal segment 282 and a beveled segment 284 with the horizontal and beveled segments of the top edge of each tab corresponding to the top edge 258 and beveled edge 260 of the side plates of the clip. Either before or after the clip is releasably connected to a hangar pin, the tabs 276 of a vane are pinched together and slid horizontally into the space between the projecting lips 262 of a clip and then forced outwardly into the spaces 272 between the H-shaped projection 268 and the side plates of the clip so that a tab is disposed on each side of the H-shaped projection. The notches 280 in the tabs are adapted to receive the lips 262 and 266 that project inwardly from the side plates of the clip to support the vane on the clip. The separation of the spaces 272 in the clip on opposite sides of the H-shaped projection retain the sidewalls of the vane in a spaced relationship so that the vane remains tubular as is desired. The tubular configuration of the vanes is formed in accordance with the teachings in U.S. Pat. No. 5,797,442 which is of common ownership with the present application and the disclosure therein is hereby incorporated by reference. In some instances it may be desired to include reinforcement at the top of the vane for supporting the clip 250 and in accordance therewith, a reinforcing strip of generally tubular configuration can be incorporated, As seen in FIG. 10, the reinforcement strip can extend down from the top of the vane a short distance while conforming to the configuration of the vane and also having tabs 276' which conform with the tabs 276 at the top of the vane.

The positioning of the tabs 276 along the top edge of each vane is such that when a vane is suspended from a connector clip 250, the vane will hang vertically with the top edge of the vane extending in a horizontal plane. The dimensions of the hangar pin 46, clip 250 and tabs 276 are also predetermined so that the top edge 277 of the vane, when suspended from a hangar pin and clip, is immediately adjacent to but in slightly spaced relationship from the bottom wall 54 of the head rail. A spacing in the range of 1/16 inch to 1/4 inch is desirable.

Figure 14:
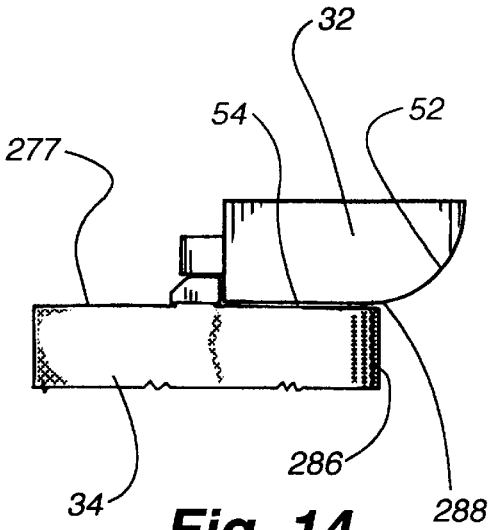
FIG. 14 is a fragmentary end view of a first design of the head rail illustrating its aesthetic cooperation with suspended vanes.
Figure 15:
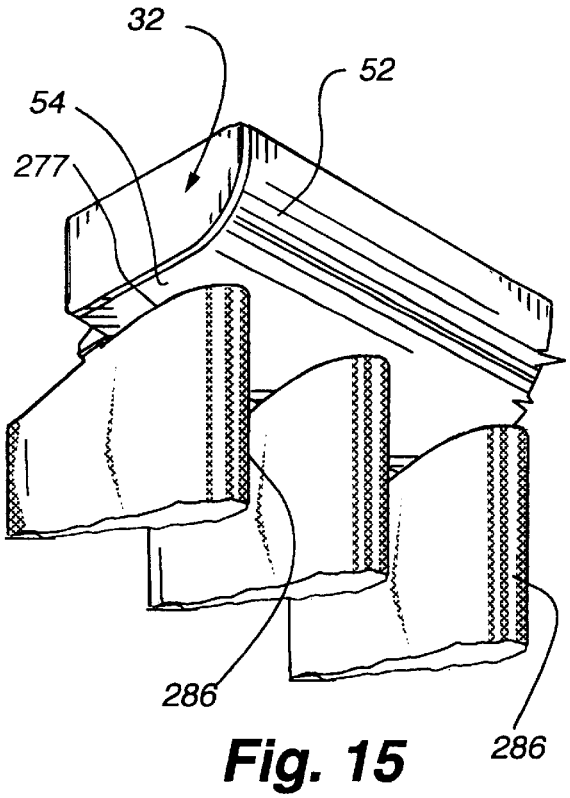
FIG. 15 is a fragmentary isometric of the embodiment shown in FIG. 14.

The head rail, vanes, and the mounting of the carriers within the head rail have been carefully designed and configured to provide improved aesthetics for the covering. With reference to FIGS. 14 and 15, it will be appreciated that the leading edge 286 of each vane, which is directed toward the interior of the structure in which the architectural opening is provided, is vertically aligned with the juncture 288 of the bottom wall 54 of the head rail with the front wall 52 of the head rail when the vane is in an open position. Due to the close spacing of the bottom wall of the head rail from the top edge of the vane, the leading edge of the vane appears to continue upwardly along the arcuate front wall 52 of the head rail. It will also be appreciated that the carriers, hangar pins and tabs are substantially eliminated from view so that all one effectively sees is the head rail and the vanes which appear to have a continuous and almost integrated relationship.

Figure 16:
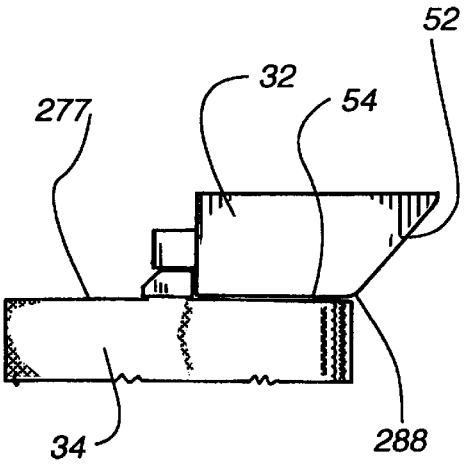
FIG. 16 is a fragmentary end view of a second design of the head rail of the present invention illustrating its aesthetic cooperation with suspended vanes.
Figure 17:
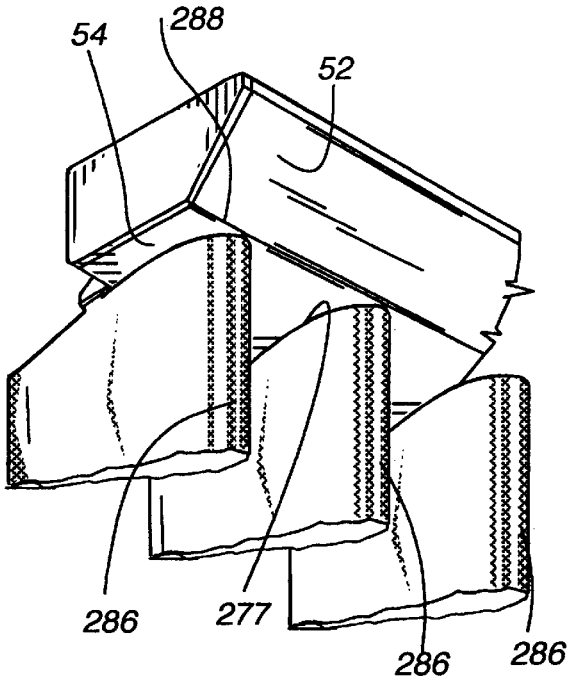
FIG. 17 is a fragmentary isometric of the design shown in FIG. 16.

FIGS. 16 and 17 show an alternative embodiment of the head rail wherein the front wall 52 of the head rail instead of being arcuate, as in the first described embodiment, is a flat beveled surface but again, the leading edges 286 of the vanes are aligned with the juncture line 288 between the front wall 52 and the bottom wall 54 of the head rail when the vanes are in the open position to again provide the continuous and integrated appearance of the first described embodiment.

Figure 18:
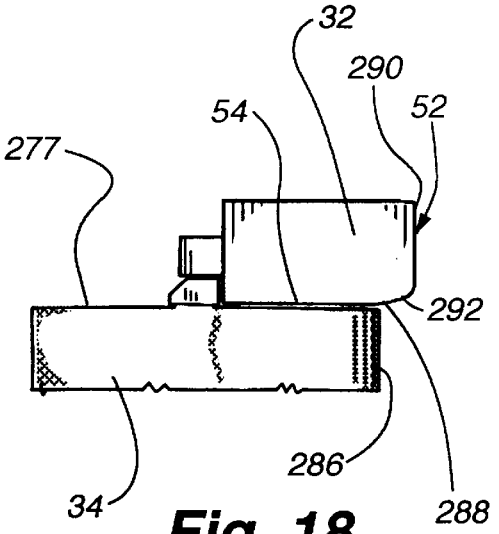
FIG. 18 is a fragmentary end view showing a third design of the head rail of the present invention illustrating its aesthetic cooperation with suspended vanes.
Figure 19:
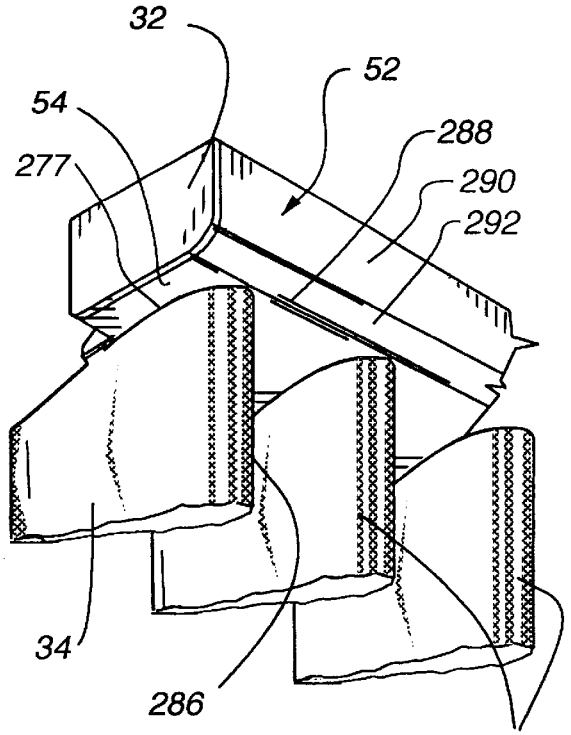
FIG. 19 is a fragmentary isometric view of the design shown in FIG. 18.

In a third embodiment illustrated in FIGS. 18 and 19, the front wall 52 of the head rail has a vertical portion 290 and at the lower edge thereof a beveled portion 292 that again joins the bottom wall 54 of the head rail along a juncture line 288 that is in vertical alignment with the leading edges 286 of the vanes when the vanes are in an open position so that again the vanes and head rail have a continuous and integrated appearance.

Figure 20:
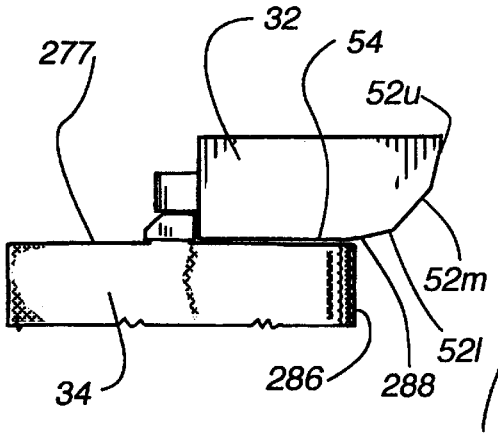
FIG. 20 is a fragmentary end view of a fourth design of a head rail showing its aesthetic cooperation with suspended vanes.
Figure 21:
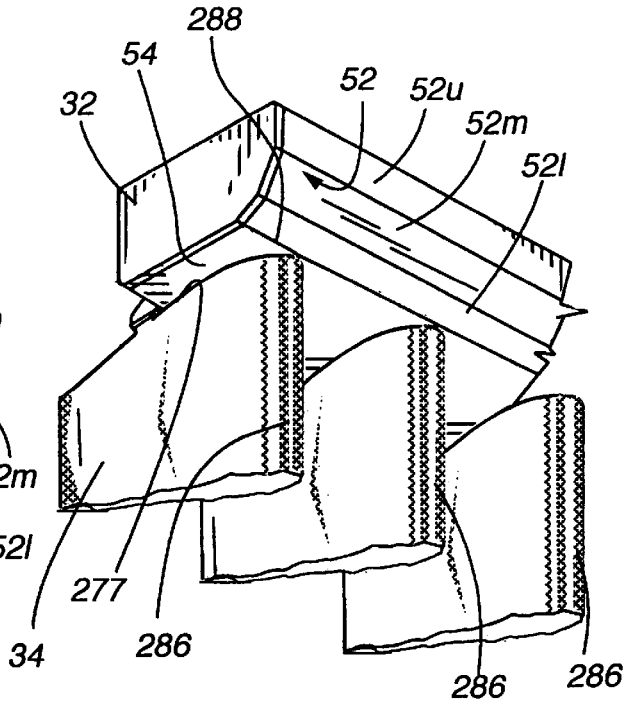
FIG. 21 is a fragmentary isometric of the design shown in FIG. 20.
Figure 22:
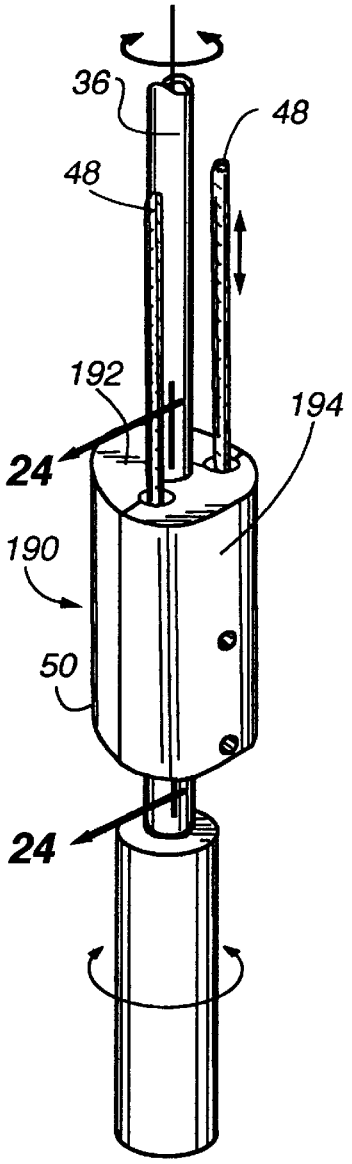
FIG. 22 is a fragmentary isometric illustrating a portion of an operating wand used in the operating system of the present invention.

FIGS. 20 and 21 disclose still a further embodiment of the covering wherein the front wall 52 of the head rail has three beveled surfaces 52*u*, 52*m* and 52*l* with the lowermost one 52*l* intersecting the bottom wall 54 of the head rail along a juncture line 288 that is in alignment with the leading edges 286 of the vanes when the vanes are in an open position. It should be appreciated, that the alignment of the leading edge of the vanes with the juncture line between the front and bottom walls of the head rail only exists when the vanes are in an open position and when the vanes are closed into overlapping substantially co-planer relationship (not shown), the vanes are displaced rearwardly of the juncture line between the front wall and the bottom wall of the head rail but due to the close spacing between the top edge 277 of the vanes and the bottom wall 54 of the head rail 32, a continuous and integrated appearance is still maintained.

In FIGS. 1–3, it will be appreciated that the head rail can be covered with a fabric or material 294 that is identical to the fabric or material from which the vanes are made to enhance the continuity between the vanes and the head rail.

It will be appreciated from the aforedescribed covering that not only is the covering pleasing to the eye by hiding most of the hardware and rendering the appearance of the vane as a continuation of the front wall of the head rail, but an improved and simplified operating system in the form of a control wand and pull cord combination renders the covering very easy to operate. An improved pantograph allows the vanes to be closely stacked adjacent to one end of the head rail without sacrificing strength and therefore quality in the control system and a simplified system for releasably connecting the vanes to the control system so as to retain the vanes in a tubular orientation has also been provided.

Although the present invention has been described with a certain degree of particularity, it is understood that the present disclosure has been made by way of example, and changes in detail or structure may be made without departing from the spirit of the invention as defined in the appended claims.

What is claimed is:

1. An operating system for a covering architectural opening comprising:

an elongated tilt wand having a longitudinal axis, a pull cord and a coupler for operatively connecting the tilt wand and the pull cord, said coupler including an anchor collar rotatably disposed on said tilt wand, a pair of housing members releasably secured to said anchor collar, said housing members when secured to said anchor collar defining an internal cavity, a fixed collar including a connector for securing the fixed collar to said tilt wand for movement therewith, said fixed collar being confined in said cavity when secured to said tilt wand, and a bearing surface in at least one of said housing members around which said pull cord is movably disposed, whereby said coupler is fixed to said tilt wand to maintain the position of the coupler at a predetermined location along the length of said tilt wand while allowing the tilt wand to rotate about a longitudinal axis relative to the coupler and for maintaining tension on said pull cord.

2. The operating system of claim 1 wherein said cavity is larger than said fixed collar so as to allow a predetermined amount of movement of the fixed collar and tilt wand relative to the coupler along said longitudinal axis.

3. The operating system of claim 1 wherein said bearing surface is a stationary surface along which said pull cord is allowed to slide.

4. The operating system of claim 3 wherein said bearing surface is a smooth arcuate surface.

5. The operating system of claim 1 wherein said housing members include resilient catch arms and said anchor collar includes notches adapted to releasably receive said catch arms to releasably secure said housing members to said anchor collar.

6. The operating system of claim 4 wherein said bearing surface is disposed on only one of said housing members.

7. The operating system of claim 1 wherein said housing members cooperate in defining a second internal cavity, said second internal cavity being sized to receive said anchor collar.

8. The operating system of claim 7 wherein said second internal cavity is defined between a partition and a catch arm in each of said housing members, said partitions and catch arms of each housing member being aligned transversely of said longitudinal axis.

9. The operating system of claim 6 wherein said one of said housing members has a top wall and a pair of openings in said top wall aligned with said arcuate bearing surface such that said pull cord extends through one of said openings, passes along said bearing surface and extends out through the other of said openings in the top wall.

10. A control system for a vertical vane covering for an architectural opening comprising:

an elongated head rail, an elongated tilt rod positioned in said head rail, a plurality of carriers slidably disposed on said tilt rod, each carrier supporting a vane for movement along said tilt rod and for pivotal movement about a longitudinal substantially vertical axis of said vane, a pull cord operatively associated with said carriers for moving said carriers along said tilt rod, and a pantograph interconnecting said carries for controlling relative movement thereof, wherein said head rail has a hollow interior, a front wall, a bottom wall and an open rear wall defining a rear edge of the head rail opposite said front wall, a majority portion of each of said carriers and portion of said pantograph being positioned inwardly of a vertical plane through said rear edge and minority portion of each of said carriers and portion of said pantograph protruding outwardly of said vertical plane through said rear edge, said minority portion of each carrier having a vane suspended therefrom.

11. The control system of claim 10 wherein said head rail has at least one guide track extending along it length within the hollow interior that cooperates with said carriers in guiding movement of the carriers along said tilt rod.

12. The control system of claim 11 wherein there are two of said guide tracks.

13. The control system of claim 11 wherein each of said carriers has a guide member adapted to cooperate with said guide track in guiding movement of the carrier along said tilt rod.

14. The control system of claim 12 wherein each of said carriers has a pair of guide members adapted to cooperate with said guide tracks in guiding movement of the carrier along said tilt rod.

15. The control system of claim 10 further including a pivot pin in said minority portion of each carrier and a connector releasably securing a vane to said pivot pin.

16. The control system of claim 15 further including a rack and pinion system in each carrier operatively interconnecting said tilt rod and said pivot pin such that rotative movement of said tilt rod causes pivotal movement of said pivot pins.

17. The control system of claim 16 further including an operator member for selectively rotating said tilt rod.

18. The control system of claim 17 wherein said operator member is a tilt wand disposed for manipulation by an operator of said control system.

19. A vertical vane covering for an architectural opening comprising:

an elongated head rail having a front wall and a bottom wall with the front wall and bottom wall intersecting along a line of juncture, a plurality of vanes vertically suspended from said head rail for movement along said head rail, each of said vanes having a front edge, a rear edge and oppositely directed sides, and a control system operatively associated with said head rail and vanes for moving said vanes along said head rail and for pivoting said vanes about vertical axes between open and closed positions of the vanes with the vanes being perpendicular to said head rail in the open position, wherein the front edge of each vane is vertically aligned with said line of juncture when the vanes are in the open position.

20. The covering of claim 19 wherein said front wall of said head rail is non-planar.

21. The covering of claim 19 wherein said front wall of said head rail forms an acute angle with vertical.

22. The covering of claim 19 wherein said front wall of said head rail is comprised of a plurality of planar segments at least one of which forms an acute angle with vertical.

23. The covering of claim 19 wherein said front wall of said head rail is arcuate in transverse cross-section.

24. The covering of claim 19 wherein each vane has a top edge and wherein said top edge is only slightly spaced from said bottom wall of said head rail.

25. The covering of claim 24 wherein said top edge of said vanes is parallel with said bottom wall of said head rail.

26. A vertical vane covering for an architectural opening comprising:

a head rail, a plurality of carriers mounted on said head rail and operatively connected to said vanes, and a pantograph operably interconnecting said carriers to affect movement of said carriers along the length of said head rail, said pantograph including first and second sets of pivotally interconnected links with the links in the first set extending parallel with each other and the links in the second set extending parallel with each other and wherein the links in at least one of said sets have first and second ends pivotally connected to links of the other set and opposite side edges extending between the first and second ends in non-parallel relationship.

27. The covering of claim 26 wherein said side edges are straight.

28. The covering of claim 26 wherein said first and second ends are of different widths.

29. The covering of claim 27 wherein said side edges of adjacent links in said one set are divergent in opposite direction.

30. A system for suspending a vane vertically from a carrier in a covering for an architectural opening wherein said carrier supports a pair of depending resilient legs having catches on the lowermost ends thereof, said system comprising in combination:

a pair of upstanding arms on said vane, each arm having a latch location thereon, and a clip for operably connecting said depending legs with said upstanding arms of said vane, said clip including a passage therein adapted to receive said depending legs such that said catches releasably grip said clip, and a pair of spaced openings with each opening adapted to individually receive one of said arms such that said latch locations on said arms releasably grip said clip.

31. The system of claim 30 wherein said clip has a top and bottom surface and said passage extends through the clip from said top to bottom surface and said depending legs are adapted to extend through said passage such that said catches grip the bottom surface of said clip.

32. The system of claim 31 wherein said depending legs are spaced apart in their natural position and must be flexed toward each other to allow the catches to be passed through the passage.

33. The system of claim 30 wherein said clip has a pair of lips aligned with said spaced openings such that when said arms are positioned in said openings said latch locations cooperate with said lips in releasably retaining said arms in said openings.

34. The system of claim 31 wherein said clip has a pair of lips aligned with said spaced openings such that when said arms are positioned in said openings said latch locations cooperate with said lips in releasably retaining said arms in said openings.

35. The system of claim 34 wherein said spaced openings are separated by said passage.

36. The system of claim 33 wherein said spaced openings are of substantially rectangular configuration and said lips are aligned with the length of said rectangular openings.

37. The system of claim 36 wherein said latch locations are notches in said arms.

38. The system of claim 37 wherein there are two lips associated and aligned with each rectangular opening and each arm has a pair of notches with each notch of a pair adapted to receive one of said lips associated with an opening.

* * * * *